United States Patent [19]

Miyagaki et al.

[11] Patent Number: 4,622,922

[45] Date of Patent: Nov. 18, 1986

[54] COMBUSTION CONTROL METHOD

[75] Inventors: Hisanori Miyagaki, Hitachiota; Toshihiko Higashi; Atsushi Yokogawa, both of Hitachi; Yoshihiro Shimada, Izumi; Nobuo Kurihara, Hitachiota; Mitsuyo Nishikawa, Hitachi; Yoshio Sato, Hitachi; Atsumi Watanabe, Hitachi; Yasuo Morooka, Hitachi, all of Japan

[73] Assignee: Hitachi, Ltd., Tokyo, Japan

[21] Appl. No.: 743,439

[22] Filed: Jun. 10, 1985

[30] Foreign Application Priority Data

Jun. 11, 1984 [JP] Japan ..... 59-118296
Oct. 15, 1984 [JP] Japan ..... 59-215691
Feb. 1, 1985 [JP] Japan ..... 60-16554

[51] Int. Cl.[4] ..... F22B 37/42

[52] U.S. Cl. ..... 122/449; 122/4 D; 431/10; 110/347; 110/190; 110/185

[58] Field of Search ..... 110/185, 190, 263, 345, 110/347, 346; 431/10; 122/4 D, 449

[56] References Cited

U.S. PATENT DOCUMENTS 4,335,084 6/1982 Brogan ..... 110/345
4,335,683 6/1982 Criswell et al. ..... 122/4 D
4,368,031 1/1983 Chadshay ..... 110/185
4,403,941 9/1983 Okiura et al. ..... 110/347
4,422,391 12/1983 Izuha et al. ..... 110/263
4,424,754 1/1984 Coleman et al. ..... 110/190
4,528,918 7/1985 Sato et al. ..... 110/185

*Primary Examiner*—Henry C. Yuen
*Attorney, Agent, or Firm*—Antonelli, Terry & Wands

[57] ABSTRACT

A combustion control method wherein manipulated variables or the amounts of fuel and air in at least one combustion zone of a boiler are regulated so that both the amount of nitrogen oxides and the amount of unburned coal in the ash at an outlet of a burner furnace or at least one of them passes the regulation standards and satisfies the requirements for operating a plant. The method is characterized by varying the amounts of fuel and air in performing trial operations on manipulated variables to evaluate the nitrogen oxides at the furnace outlet, the unburned coal in the ash at the furnace outlet and the stability of combustion, and declaring as optimum manipulated variables those amounts of fuel and air used for performing the trial operations which achieve results such that the combustion is found to be stabilized, at least the nitrogen oxides at the furnace outlet satisfy the requirement and the thermal efficiency of the boiler is judged to be at the highest level by a boiler thermal efficiency judging section.

19 Claims, 39 Drawing Figures

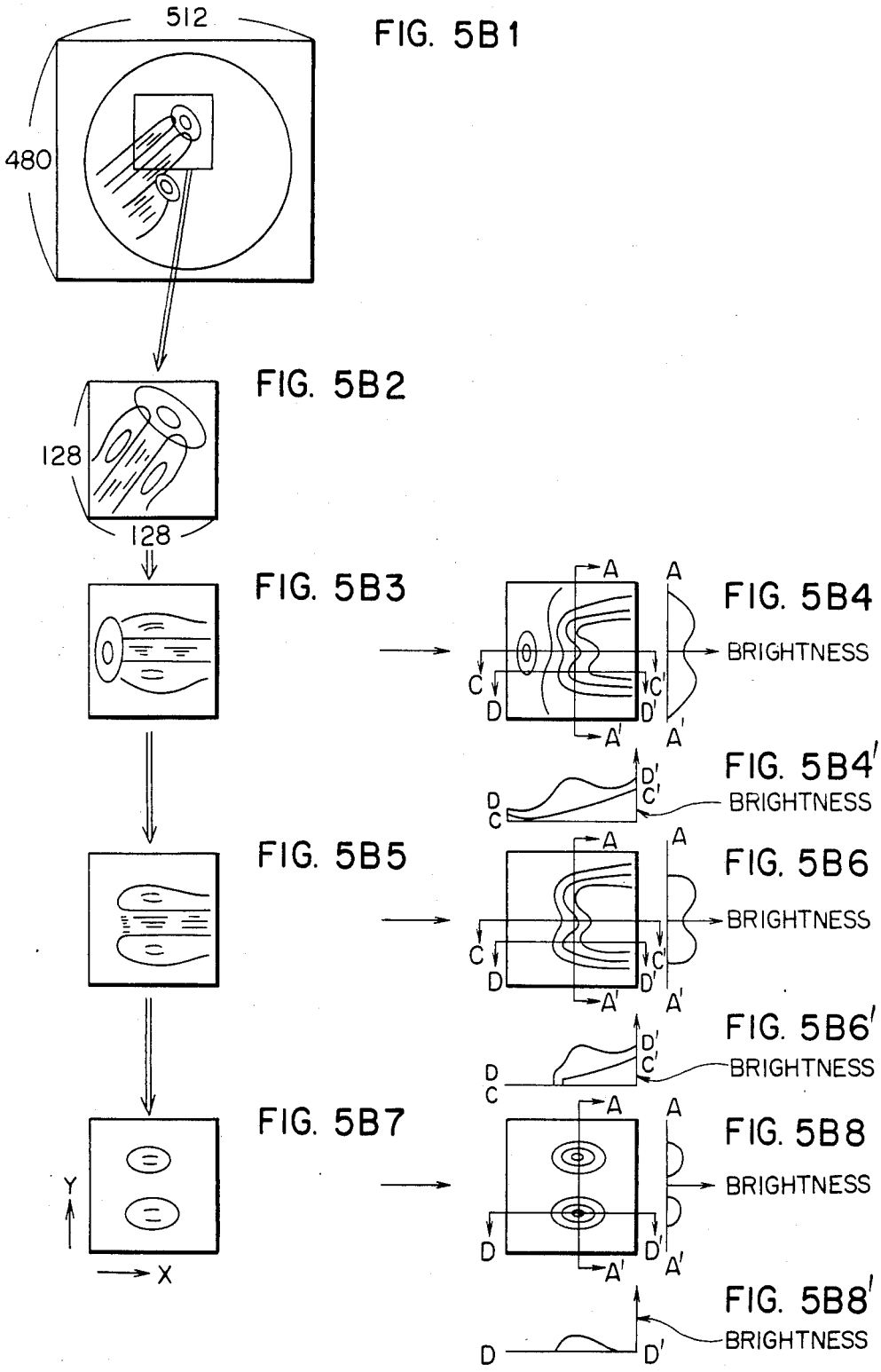
512
480
FIG. 5B1
128
128
FIG. 5B2
FIG. 5B3
A
A'
C
C'
D
D'
BRIGHTNESS
FIG. 5B4
FIG. 5B4'
FIG. 5B5
FIG. 5B6
FIG. 5B6'
FIG. 5B7
Y
X
FIG. 5B8
FIG. 5B8'

FIG. 6A1
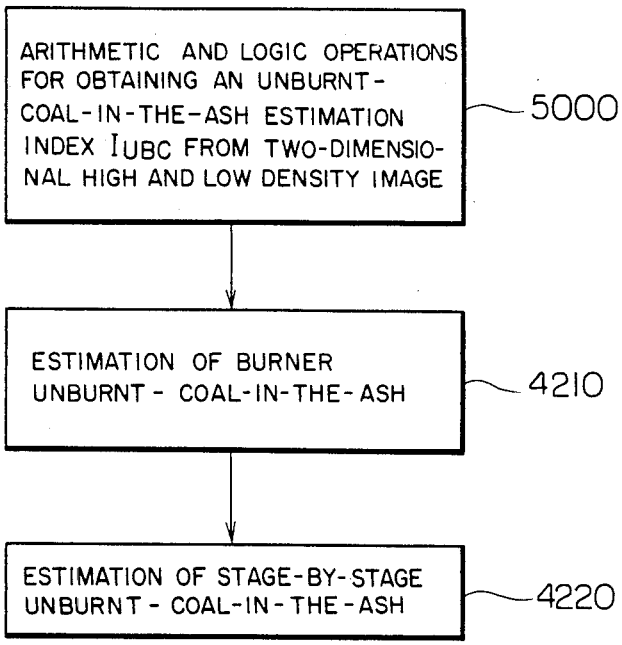
FIG. 6A2
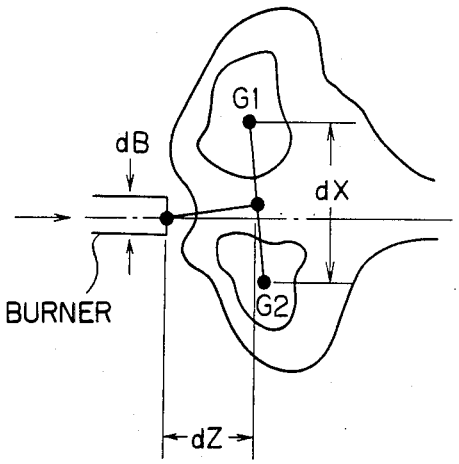

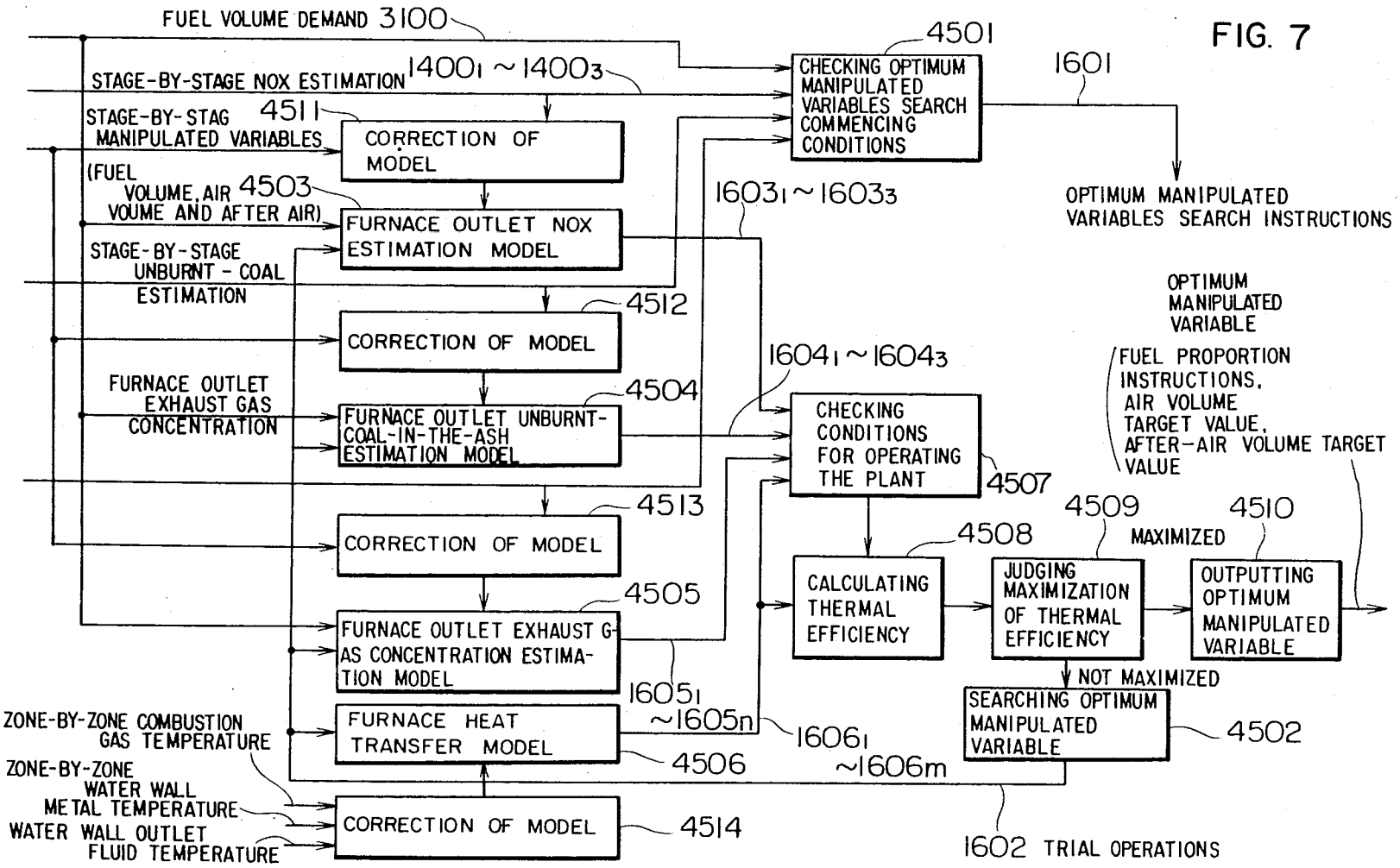
FIG. 7
FUEL VOLUME DEMAND 3100
STAGE-BY-STAGE NOX ESTIMATION 1400₁ ~ 1400₃
STAGE-BY-STAG MANIPULATED VARIABLES 4511
(FUEL VOLUME, AIR VOUME AND AFTER AIR) 4503
STAGE-BY-STAGE UNBURNT - COAL ESTIMATION
FURNACE OUTLET EXHAUST GAS CONCENTRATION
ZONE-BY-ZONE COMBUSTION GAS TEMPERATURE
ZONE-BY-ZONE WATER WALL METAL TEMPERATURE
WATER WALL OUTLET FLUID TEMPERATURE
CHECKING OPTIMUM MANIPULATED VARIABLES SEARCH COMMENCING CONDITIONS
4501
1601
OPTIMUM MANIPULATED VARIABLES SEARCH INSTRUCTIONS
CORRECTION OF MODEL
FURNACE OUTLET NOX ESTIMATION MODEL
1603₁ ~ 1603₃
CORRECTION OF MODEL
4512
FURNACE OUTLET UNBURNT-COAL-IN-THE-ASH ESTIMATION MODEL
4504
CHECKING CONDITIONS FOR OPERATING THE PLANT
4507
1604₁ ~ 1604₃
OPTIMUM MANIPULATED VARIABLE
(FUEL PROPORTION INSTRUCTIONS, AIR VOLUME TARGET VALUE, AFTER-AIR VOLUME TARGET VALUE)
CORRECTION OF MODEL
4513
CALCULATING THERMAL EFFICIENCY
4508
JUDGING MAXIMIZATION OF THERMAL EFFICIENCY
4509
MAXIMIZED
OUTPUTTING OPTIMUM MANIPULATED VARIABLE
4510
NOT MAXIMIZED
SEARCHING OPTIMUM MANIPULATED VARIABLE
4502
1602 TRIAL OPERATIONS
FURNACE OUTLET EXHAUST GAS CONCENTRATION ESTIMATION MODEL
4505
1605₁ ~ 1605n
FURNACE HEAT TRANSFER MODEL
4506
1606₁ ~ 1606m
CORRECTION OF MODEL
4514

NOTE) $L^*$: FUEL VOLUME DEMAND OBTAINED WHEN OPTIMUM MANIPULATED VARIABLES WERE DETERMINED

L: CURRENT FUEL VOLUME DEMAND

FIG. 13 (1/2)
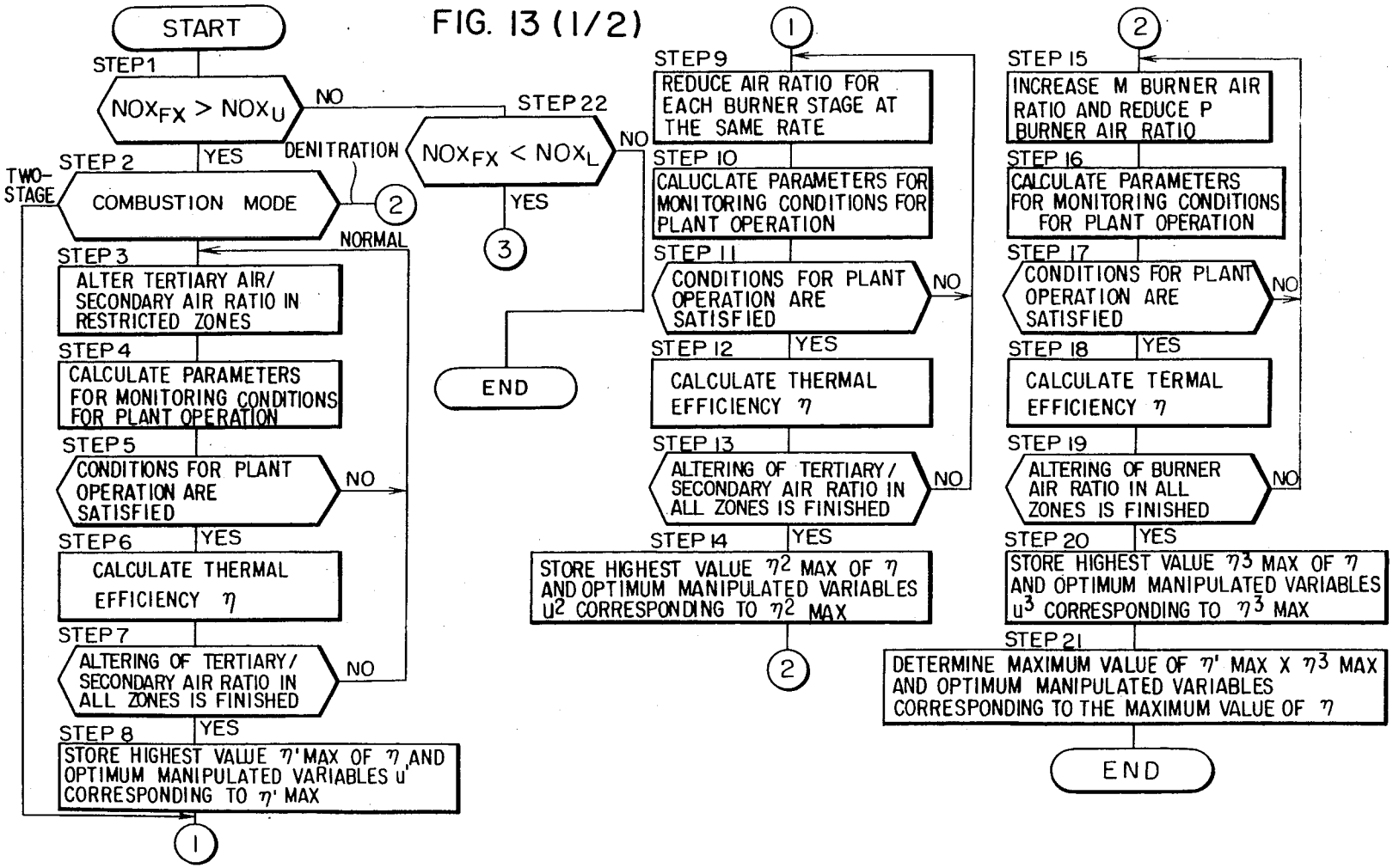

FIG. 13 (2/2)
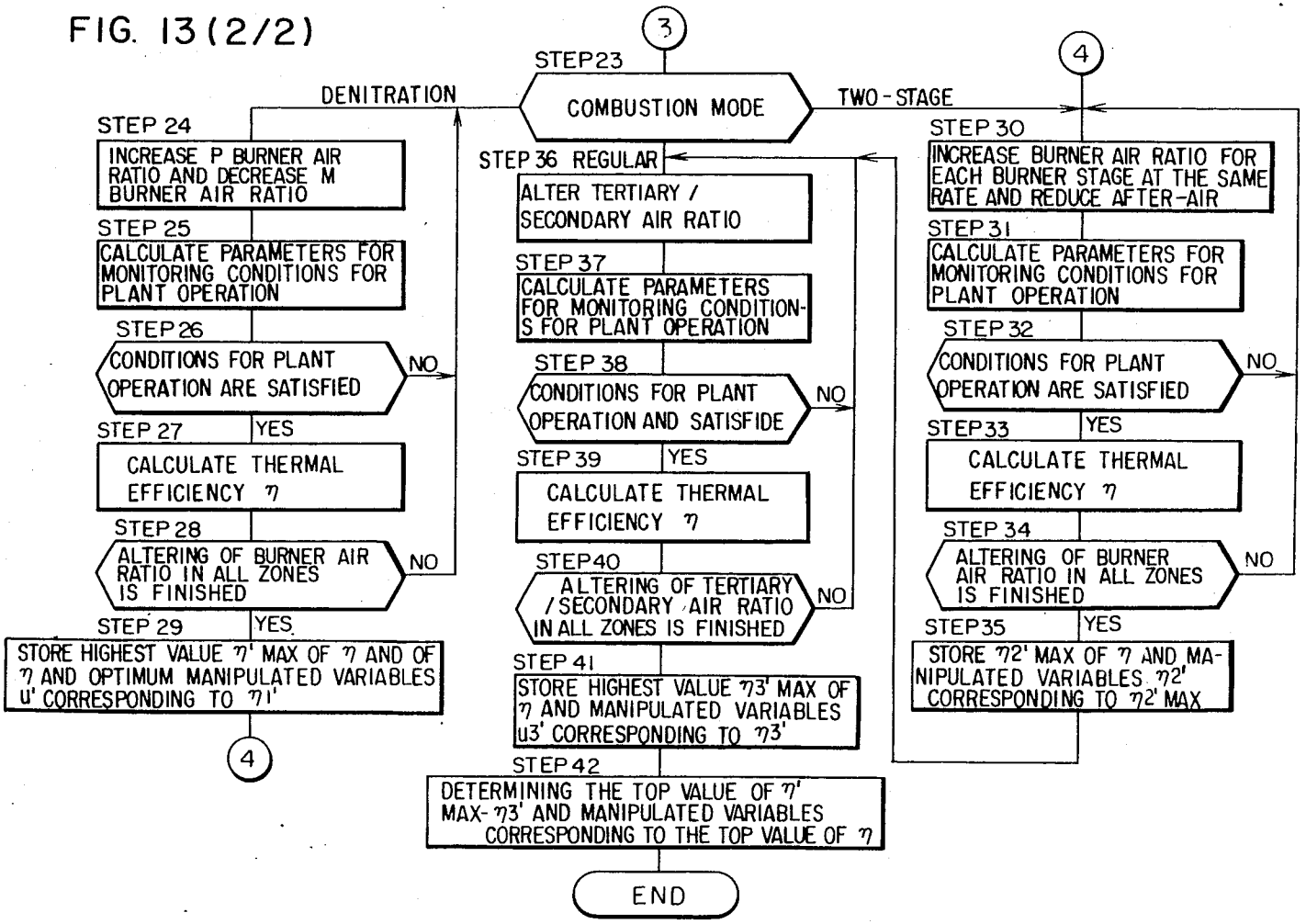

FIG. 14

| NO | MODE | CONDITION | | |
|---|---|---|---|---|
| | | DEGREE OF OPENING OF NO PORT DAMPER | P BURNER AIR RATIO | M BURNER AIR RATIO |
| 1 | REGULAR COMBUSTION | 0 % | $\lambda p \geqq 1$ | $\lambda_{M1} \geqq 1$<br>$\lambda_{M2} \geqq 1$ |
| 2 | TWO-STAGE CUMBUSTION | > 0 % | $\lambda p \cong \lambda_{M1} \cong \lambda_{M2} < 1$ | |
| 3 | DENITRATION COMBUSTION | > 0 % | $\lambda p < 0.8$ | $\lambda_{M1} \geqq 1$<br>$\lambda_{M2} \geqq 1$ |

COMBUSTION CONTROL METHOD

BACKGROUND OF THE INVENTION

This invention relates to methods of and apparatus for controlling combustion in furnaces, and more particularly it is concerned with a combustion control method suitable for maintaining the thermal efficiency of a plant at a highest possible level while meeting the requirements of minimizing the amounts of the oxides of nitrogen produced and the unburned fuel remaining in the ash which are necessary in operating the plant to avoid air pollution.

Heretofore, several methods have been available for controlling combustion taking place in a furnace. In one method known in the art, rays of light emitted by the flames produced by combustion in the furnace are monitored and the ratio of the fuel volume to the air volume supplied to the furnace is controlled in such a manner that the spectrographic intensity of the light is maximized to obtain thermal energy with a maximum efficiency, as disclosed in Japanese Patent Application Laid-Open No. 100224/81 entitled "Method and Apparatus for Controlling Combustion". In another method known in the art, the volume of air supplied to the furnace for combustion is efficiently controlled in accordance with the volume of light emitted by the flames of combustion, to thereby optimize the volume of supplied air, as disclosed in Japanese Patent Application Laid-Open No. 151814/81 entitled "Apparatus for Controlling the Volume of Supplied Air for Combustion". These methods are considered to have effect in maximizing combustion efficiency, but they are unable to effect combustion control in such a manner that the heat absorption factor of the boiler is maximized while achieving the stabilization of combustion.

Meanwhile, no closed-loop control methods have ever been employed for controlling the volume of the nitrogen oxides in the furnace. The reason why such methods have not been adopted is because of the inability to accurately measure the volume of the oxides of nitrogen produced in the furnace as the current state of the art makes it impossible to determine the volume of fuel and air to be controlled to effect control of the volume of the oxides of nitrogen in the furnace. Thus, it has hitherto been usual practice to effect open-loop control of the volume of the oxides of nitrogen by monitoring the value of the oxides of nitrogen sensed at the outlet of the furnace after deciding the volumes of fuel and air conforming to a load in accordance with a program control. Thus, it has hitherto been impossible to control the volume of the oxides of nitrogen satisfactorily in plants where the character of fuel undergoes a change due to a variation in the type of coal burned or the volume of coal supplied show fluctuations.

With regard to the stability of combustion, it has hitherto been the usual practice to rely on the use of a television camera mounted to a peep hole at the top of the furnace for obtaining an image of the flames produced in the furnace by combustion which is shown on monitor television receivers to enable the operator to assess the condition of combustion to determine its stability. This method requires the use of operators qualified to do the job and having long experiences in fulfilling the duties, and suffers the disadvantage that the results achieved may vary from one operator to another because the assessments might possibly be affected by individual propensity.

As noted hereinabove, the current state of the art concerning combustion control makes it impossible to effect control of combustion in plants, particularly those plants in which the character of fuel undergoes a change or the volume of supplied fuel shows fluctuations, in such a manner that the combustion is stabilized and the thermal efficiency is maintained at the highest level possible while the requirements to keep the parameters important in operating a plant, such as the amounts of the oxides of nitrogen produced and the unburned fuel remaining in the ash, at desired levels are met.

SUMMARY OF THE INVENTION

This invention has as its object the provision of a combustion control method capable of achieving combustion in a plant which is stable and high in efficiency by coping with variations in the amount of fuel supplied to the furnace, changes in the character of fuel supplied to the furnace and variations in the load requirements while meeting the requirements of keeping the amounts of the oxides of nitrogen produced and the unburned fuel remaining in the ash at levels below the required regulation values, so as to thereby maximize the thermal efficiency of the plant.

The present invention is based on the discovery that there is a correlation between the shape of an image of a flame produced by combustion in the vicinity of the outlet of a burner on the one hand and the amount of the oxides of nitrogen produced, the amount of the unburned fuel remaining in the ash, the efficiency of combustion and the stability of combustion in the furnace of a boiler on the other. The outstanding characteristics of the invention enabling the aforesaid object to be accomplished are that at least one of the amount of the oxides of nitrogen produced, the amount of the unburned fuel remaining in the ash, combustion efficiency and combustion stability in at least one zone of the furnace is estimated based on the shape of an image of the flames, and the proportion of the flow rate of the fuel to the flow rate of air in the at least one zone of the furnace is altered by trial in such a manner that the estimates satisfy predetermined requirements for operating the plant. Then, the thermal efficiency of the boiler is estimated by using furnace heat transfer and flow models, and the proportion of the flow rate of the fuel to the flow rate of the air which maximizes the thermal efficiency is chosen as a target value of the manipulated variable. The temperature of the gas of combustion is estimated based on the brightness information on the gas of combustion, so that the furnace heat transfer and flow models are corrected by using the estimated temperature of the gas of combustion as well as the values of water wall metal temperature and water wall outlet fluid temperature obtained by actually measuring them.

BRIEF DESCRIPTION OF THE DRAWINGS

FIGS. 5A1 to 5A3 show a flame produced in the burner by the combustion of pulverized coal and its characteristics;

FIGS. 5B1 to 5B8 are diagrams in explanation of the operation for processing an image of the flame;

FIG. 6A1 is a view in explanation of the stage-by-stage unburned-coal-in-the-ash estimation function block;

FIG. 6A2 shows the relation between the outlet of the burner and the oxidization regions of a flame;

FIG. 7 shows one constructional form of the stage-by-stage fuel/air proportion calculation function block;

FIG. 8 shows another constructional form of the stage-by-stage fuel/air proportion calculation function block;

FIGS. 12 to 14 show other examples of algorithms each for determining an optimum value for the manipulated variable for the fuel/air proportion calculation function block;

DESCRIPTION OF THE PREFERRED EMBODIMENT

Before describing in detail the preferred embodiment of the invention, a coal-burning power generating plant in which the invention can have application will be outlined.

Figure 1:
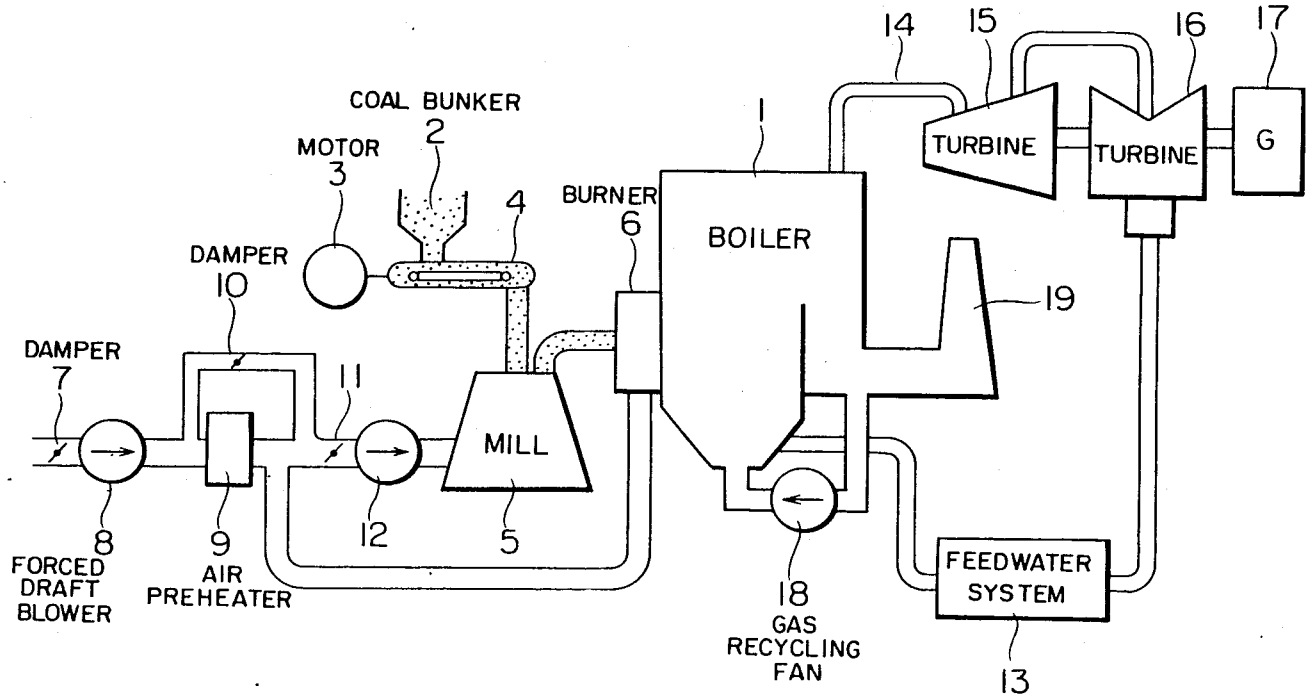
FIG. 1 is a diagram of a coal-burning power generating plant.

Referring to FIG. 1, a boiler 1 burns coal supplied from a coal bunker 2. The coal in the coal bunker 2 is fed to a mill 5 by a feeder 4 and a drive motor 3 and then supplied to a burner 6 after being pulverized in the mill 5. Air is fed by a blower 8 for producing a forced draft to an air preheater 9, and a portion of the preheated air is supplied by a primary air fan 12 to the mill 5 for conveying pulverized coal and the rest of the preheated air is led directly to the burner 6 to serve as air for combustion. A portion of the forced draft produced by the blower 8 bypasses the air preheater 9 and controls the temperature of the primary air by means of a damper 10. The total amount of air necessary for combustion and the amount of air necessary for conveying the pulverized coal are controlled by dampers 7 and 11 respectively. Meanwhile, feedwater pressurized by a feedwater system 13 is heated in the boiler and produces superheated steam which is led through a main steam line 14 to turbines 15 and 16 to rotate same as it undergoes adiabatic expansion, to generate electricity by a generator 17. The major portion of exhaust gases produced by the combustion of pulverized coal to heat the feedwater to produce the superheated steam is released to the atmosphere through a smokestack 19, but a portion of the exhaust gases is returned to the boiler 1 by a gas recycling fan 18.

Figure 2:
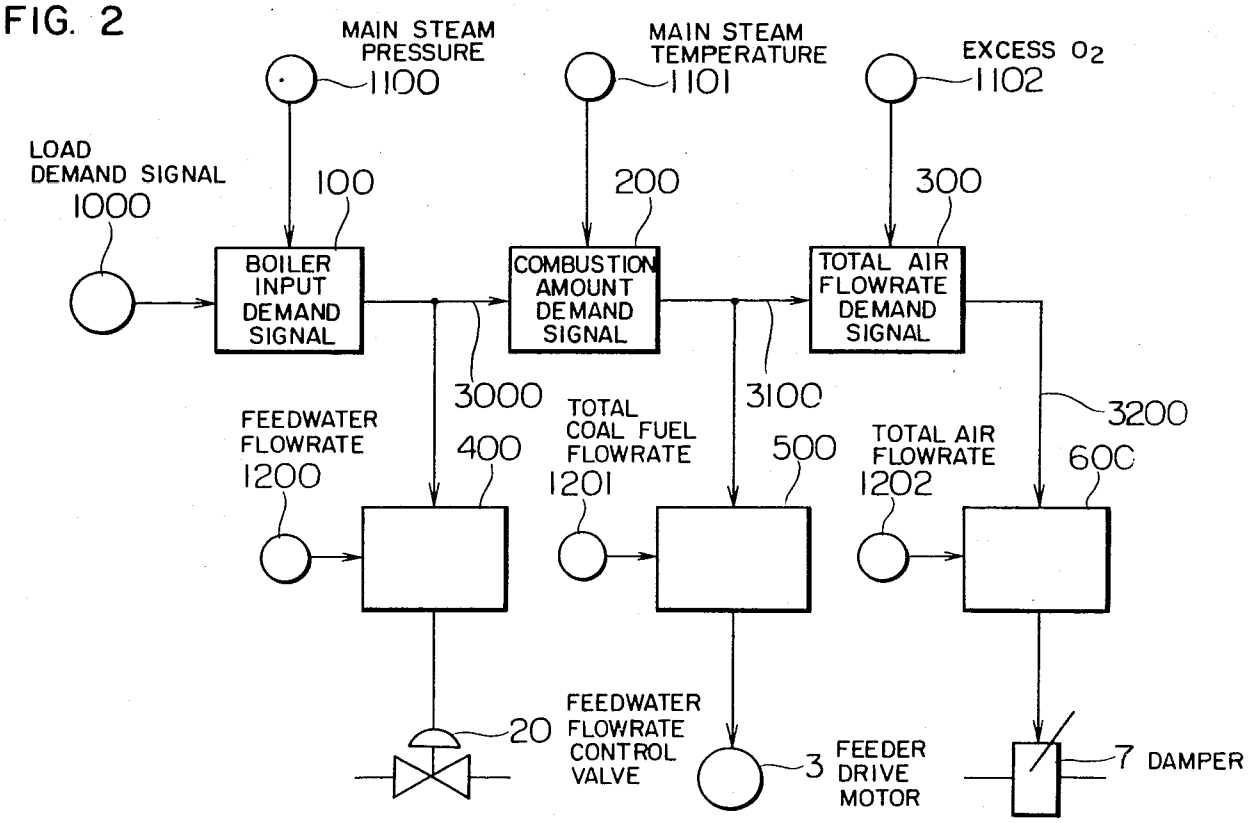
FIG. 2 is a diagram of a control system of the prior art for the coal-burning power generating plant shown in FIG. 1.

To smoothly operate the coal-burning power generating plant of the aforesaid construction in response to load demand instructions, it is necessary to control each valve, each damper and each motor in a suitable manner. FIG. 2 shows in a diagram one example of the automatic control system of the prior art for the coal-burning power generating plant shown in FIG. 1. The function of the control system shown in FIG. 2 will now be outlined.

A load demand signal 1000 for a load (output power of the generator 17) supplied to the coal-burning power generating plant is corrected (in a main steam pressure compensation block 100) to bring a main steam pressure 1100 to a predetermined value (which is constant in a constant voltage plant and which may vary depending on the load in a variable voltage plant), to produce a boiler input demand signal 3000 supplied to the boiler 1. Besides being used to control a feedwater flowrate control system 400 for setting the value of a feedwater flowrate 1200, the boiler input demand signal 3000 is also used to produce a fuel volume demand signal 3100 which is supplied to a main steam temperature compensation block 200 where the signal 3100 is corrected to bring a main steam temperature 1101 to a predetermined value, to thereby produce the fuel volume demand signal 3100. The fuel volume demand signal 3100 is fed to a fuel flowrate control system 500 to set the value of a total coal fuel flowrate 1201 which is used to control the drive motor 3 for the feeder 4. The fuel volume demand signal 3100 is corrected to bring an excess exhaust gas $O_2$ rate to a predetermined value in an air/fuel ratio compensation block 300, to produce a total air flowrate demand signal 3200. An air flowrate control system 600 controls the damper 7 to bring a total air flowrate 1202 to the same level as the total air flowrate demand signal 3200.

The automatic control system for the coal-burning power generating plant has been outlined. The coal-burning power generating plant comprises a regenerative steam temperature control system and a turbine regulating valve control system in addition to the automatic control system. However, these systems have no relevance to the present invention, so that their description will be omitted.

Figure 3:
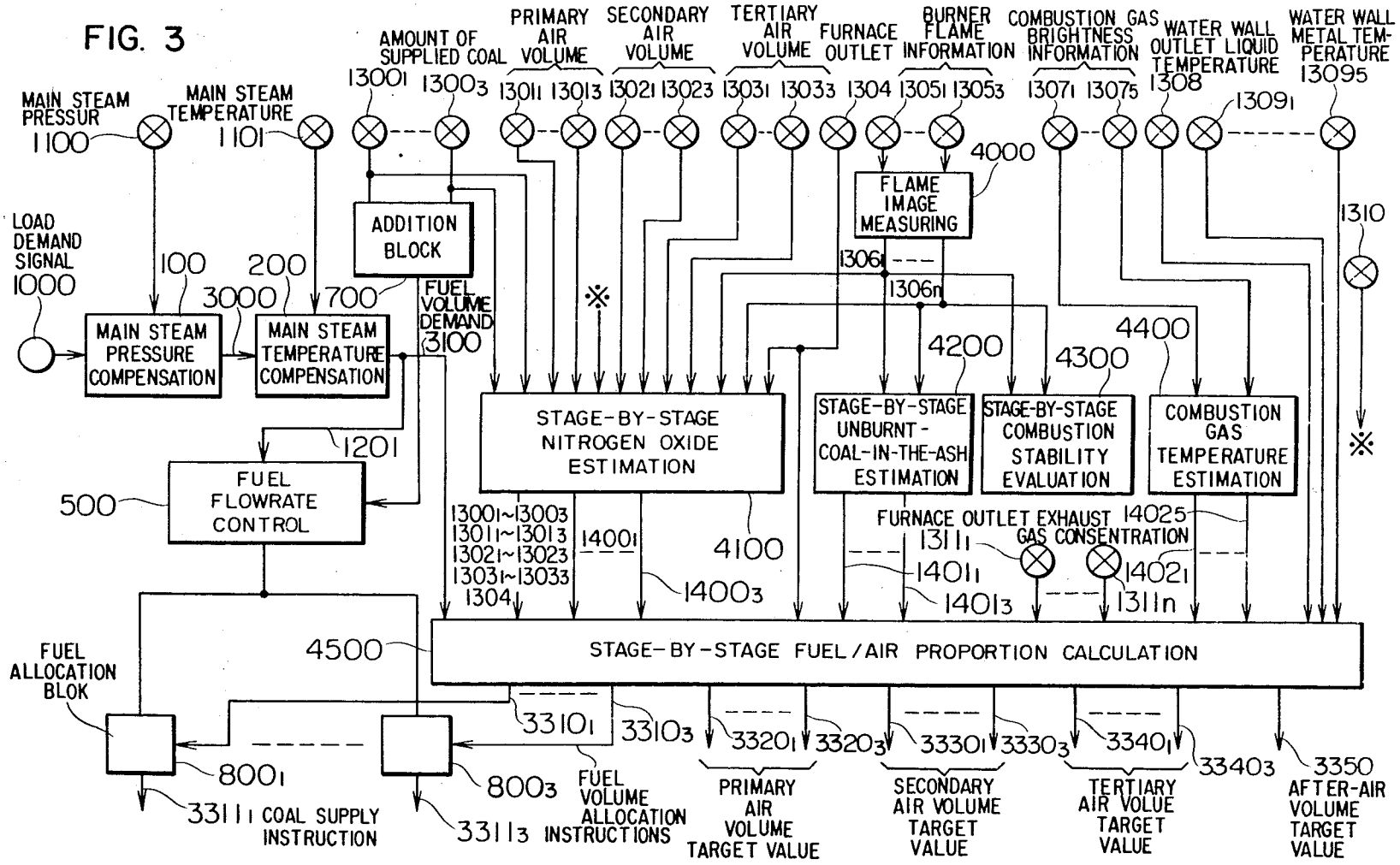
FIG. 3 is a diagram in explanation of one embodiment of the present invention.

FIG. 3 shows one embodiment of the invention which is incorporated in the coal-burning power generating plant shown and described by referring to FIGS. 1 and 2. In FIG. 3, parts similar to those shown in FIG.

Figure 4A:
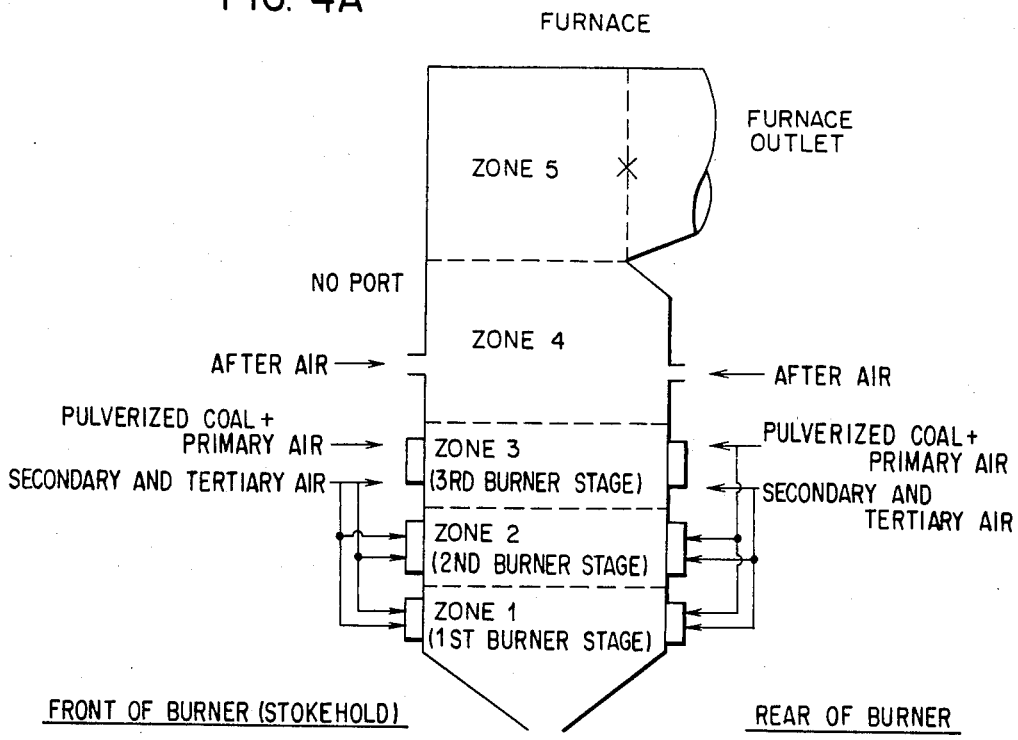
FIG. 4A shows a model of the furnace of a pulverized coal boiler.

1 are designated by like reference characters. In the embodiment of the invention incorporated in the plant shown in FIGS. 1 and 2, a furnace of a pulverized coal burning boiler constitutes the object of control and the furnace is divided into five (5) zones (of which three zones are burner zones), as shown in FIG. 4A. In the reference numerals shown in FIG. 3, the subscripts designate the numbers of the zones of the furnace. In the interest of brevity, a process signal for each zone is shown in a value representing the total of values obtained in the front and at the back of the furnace. The embodiment of the invention as incorporated in the coal-burning power generating plant as shown in FIG. 3 is characterized by the following function blocks which the coal-burning power generating plants of the prior art lack:

(1) Flame image measuring function block 4000;
(2) Stage-by-stage nitrogen oxides estimation function block 4100;
(3) Stage-by-stage unburned-coal-in-the-ash estimation function block 4200;
(4) Stage-by-stage combustion safety evaluation function block 4300;
(5) Combustion gas temperature estimation function block 4400; and
(6) Stage-by-stage fuel/air proportion calculation block 4500.

A preferred embodiment of the invention will now be described in detail by referring to FIG. 3.

Figure 4B:
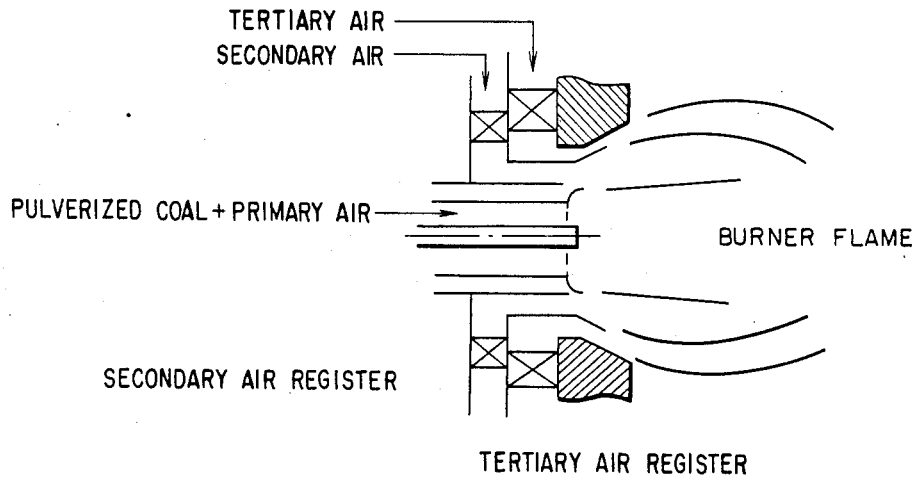
FIG. 4B shows the construction of the pulverized coal boiler shown as a model in FIG. 4A.

The flame image measuring block 4000 comprises image forming cameras each located in one of a plurality of burner stages for obtaining typical burner flame information $1305_1$–$1305_3$ for the respective stages of the burner 6 and converting the information to two-dimensional high and low density image signals $1306_1$–$1306_3$. The stage-by-stage nitrogen oxides estimation function block 4100 produces, based on the values of the burner flame information $1305_1$–$1305_3$, amounts of supplied coal $1300_1$–$1300_3$, volumes of primary air $1301_1$–$1301_3$, volumes of secondary air $1302_1$–$1302_3$, volumes of tertiary air $1303_1$–$1303_3$, after-air 1310 and furnace outlet nitrogen oxides measured values 1304, estimates of the amounts of nitrogen oxides to be produced in spaces extending from the respective burner stages to the furnace outlet. The stage-by-stage unburned-coal-in-the-ash estimation function block 4200 calculates flame characteristic parameters based on two-dimensional high and low density image signals $1306_1$–$1306_3$ and produces estimates of the unburned coal remaining in the ash in separate zones in accordance with models using these parameters (the details are described in Japanese Patent Application No. 110537/84). The stage-by-stage combustion safety evaluation function block 4300 evaluates the safety of combustion and estimates possible abnormalities which might be caused to occur by using one of two methods. One method consists in using the flame characteristic parameter based on the two-dimensional high and low density image signals $1306_1$–$1306_3$ which relates to the shape, and the other method uses the flame characteristic parameter which relates to the area of the flame. The former method is disclosed in Japanese Patent Application No. 184657/84, and the latter method is disclosed in Japanese Patent Application No. 174998/84. The combustion gas temperature estimation function block 4400 calculates combustion gas temperature estimates $1402_1$–$1402_5$ for the separate zones based on combustion gas brightness information $1307_1$–$1307_5$ for the separate zones shown in FIG. 4A. FIG. 4B shows the burner 6. The stage-by-stage fuel/air proportion calculation function block 4500 decides, upon receipt of the fuel amount requirement signal 3100, fuel proportion instructions $3310_1$–$3310_3$, primary air volume target values $3320_1$–$3320_3$, secondary air volume target values $3330_1$–$3330_3$ and tertiary air volume target values $3340_1$–$3340_3$ for the separate burner stages as well as an after-air volume target value 3350 from an NO port in such a manner that the heat introduced into and generated in the furnace is best absorbed by metals of a water wall and a radiation superheater or in a fluid flowing therethrough or, stated differently, the thermal efficiency of the boiler is maximized while meeting the requirements for performing the operation of the plant. Such requirements include keeping the furnace outlet nitrogen oxides measured values 1304 below the guideline figures, keeping below 5% the amount of the unburned coal ih the ash which plays an important role in utilizing coal ash, keeping the inlet temperature of a denitration device at a suitable level to avoid erosion of the material of the main equipment of the plant, and keeping the rate of heat flux in the water wall and radiation superheater below a predetermined level to avoid burning metals. Of all these function blocks, the stage-by-stage nitrogen oxides estimation function block 4100 and stage-by-stage unburned-coal-in-the-ash estimation function block produce outputs which are used to check whether the requirements that should be met with regard to the nitrogen oxides and the unburned coal in the ash as described hereinabove. An output of the combustion gas temperature estimation function block 4400, a water wall outlet fluid temperature 1308 and boiler wall metal temperatures $1309_1$–$1309_5$ are used as correction signals for a furnace heat transfer model for calculating the thermal efficiency of the boiler 6. The stage-by-stage combustion safety evaluation function block 4300 performs the function of monitoring the condition of combustion of coal and indicating the presence of abnormal conditions by actuating an alarm or a cathoderay display unit by its output signal.

The function blocks referred to hereinabove will now be described in detail.

Figure 5:
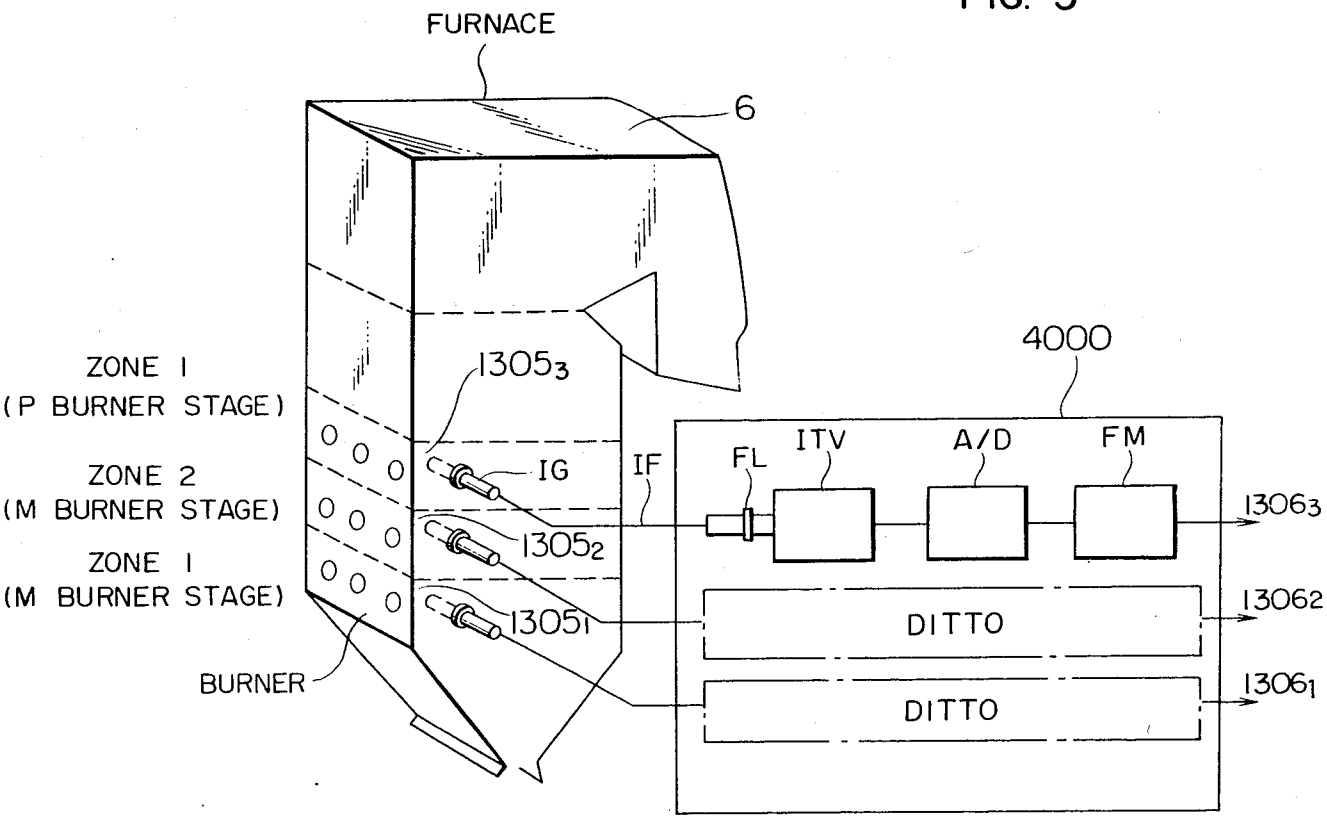
FIG. 5 is a view in explanation of the flame image measuring function block.

FIG. 5 shows one constructional form of the flame image measuring function block 4000 in which the typical burner flame images $1305_1$–$1305_3$ of burner groups of the separate stages are led via image guides IG and image fibers IF to an image-forming TV system ITV where they are converted to video signals which are converted by analog-to-digital converters A/D to digital data which is stored in frame memories FM. The data thus stored in the frame memories FM serves as the two-dimensional high and low density image signals $1306_1$–$1306_3$ for the stage-by-stage nitrogen oxides estimation function block 4100, stage-by-stage unburned-coal-in-the-ash estimation function block 4200 and stage-by-stage combustion safety evaluation function block 4300. The image guides IG should be inserted in the furnace because it is necessary to obtain the image of the flame at the root in the typical burner. Thus, the image fibers IF each have a sheath formed of a material capable of withstanding the heat of a temperature as high as 1500° C. for cooling the image fibers.

The method used for processing flame images for obtaining the two-dimensional high and low density flame image signals $1306_1$–$1306_3$ will be described.

Figure 5A:
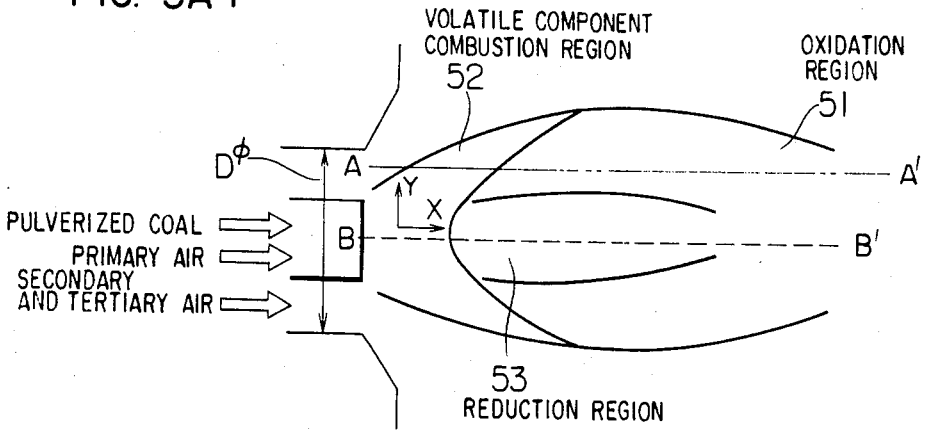
Figure 5A:
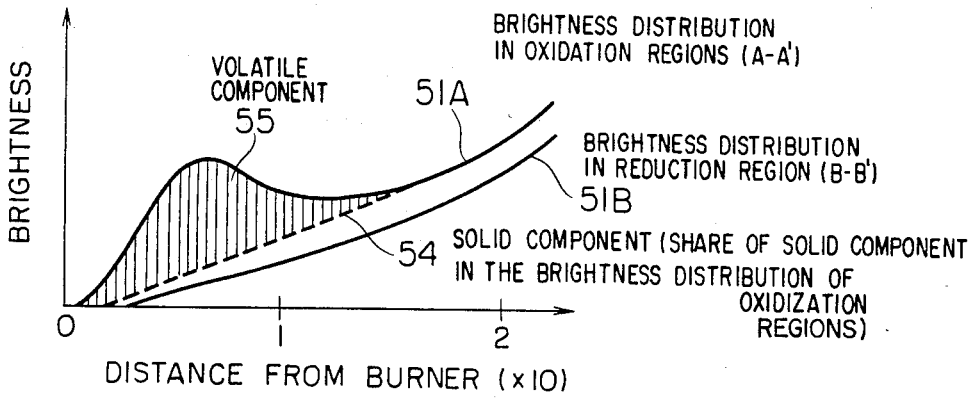
Figure 5A:
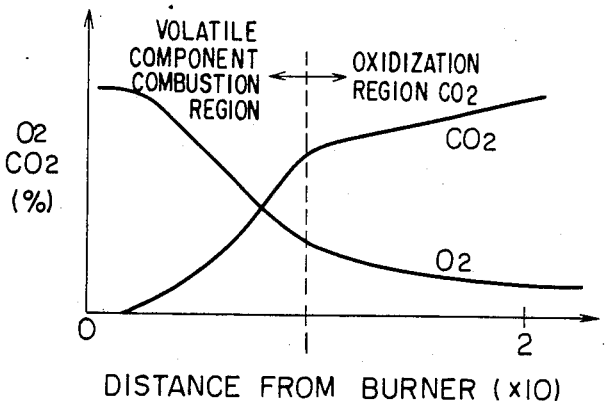

In FIG. 5A1, there is shown one example of the flame in which the reference numerals 51, 52 and 53 designate oxidization regions, volatile component combustion regions and a reduction region, respectively.

The process of combustion will be outlined. Referring to FIG. 5A1, combustion takes place as follows:

(1) Pulverized coal fed into the furnace through the burner by forming a mixture with primary air is rapidly heated by the heat of radiation from furnace walls of high temperature and the flame, and part of the minuscule coal powder undergoes disintegration due to fissure formation into still smaller particles. At the same time, a volatile component of the coal is carbonized, to suddenly release carbonization gas of a volume 500 times as great as the volume of the minuscule coal particles.

(2) The carbonization gas reacts with air present in the periphery of coke particles produced by the combustion of coal, so that diffusion combustion of the coke particles takes place, forming a volatile component combustion region.

(3) The coke particles that have their shells removed become similar in shape to pumice stones and have increased buoyancy and solid carbon burns at the surface, forming reduction and oxidization regions.

The flame comprises an outer flame portion and an inner flame portion. The outer flame portion includes the oxidization regions 51 in which the volatile component and solid component of coal burn in a state of excess oxygen, and the volatile component combustion regions 52, in which the volatile component of high combustion speed burns, are formed in a section of the oxidization regions 51 which is disposed in the vicinity of the burner. The inner flame portion includes the reduction region 53 in which the solid component burns in an oxygen-free state.

FIG. 5A2 shows brightness distributions in the reduction region 53 and oxidization regions 51 of the flame in relation to the distance from the burner. It will be seen that, whereas the brightness distribution of the reduction region 53 along a line B–B′ only shows a solid component combustion brightness 54, the brightness distribution of the oxidization regions 51 along a line A–A′ shows a volatile component combustion brightness 55 in addition to the solid component combustion brightness 54. It is shown in FIG. 5A3 that the volatile component combustion regions 52 are located in a position which is distanced from the burner by $X/D=0\sim1$, where D is the diameter of the opening of the burner.

In FIG. 5A2, the reference numerals 51A and 51B designate a brightness distribution in the oxidization region 51 along the line A–A′ in FIG. 5A1, and a brightness distribution in the reduction region 53 along the line B–B′ in FIG. 5A1, respectively. The reference numerals 54 and 55 designate a share of the solid component combustion brightness in the brightness distribution in the oxidization regions 51, and a share of the volatile component combustion brightness in the brightness distribution in the oxidization region 51, respectively. In the diagram shown in FIG. 5A2, the abscissa is represented by the distance from the forward end of the burner which is indicated by X/D with reference to the diameter of the opening of the burner.

FIG. 5A3 shows a distribution of gases produced in the oxidization region 51 along the line A–A′ shown in FIG. 5A1. It will be seen in the figure that the amount of carbon dioxide rapidly increases and the amount of oxygen rapidly decreases in a section having the distance $X/D=0\sim1$ from the burner. This shows that the combustion of the volatile component of coal takes place in this region because the volatile component has a higher combustion speed than the solid component. It will also be seen that the volatile component combustion region is distanced by $X/D<1.0$ from the burner and the oxidization region is distanced by $X/D>1.0$ from the burner.

From the foregoing, it will be seen that it is possible, by studying the brightness distributions in the flame, to obtain information on the shape and brightness of the volatile component combustion regions by separating the solid component combustion brightness from the volatile component combustion brightness in the brightness distributions, or by using a brightness conversion whereby the brightness represented by a brightness distribution is converted to a relative brightness in terms of the solid component combustion brightness.

With respect to the brightness distribution of the solid component combustion brightness which forms the basis of the brightness conversion, the brightness distribution that is obtained in the reduction region is equal to the brightness distribution of the solid component combustion brightness. However, the brightness distributions that are obtained in the oxidization region and the volatile component combustion regions contain the volatile component combustion brightness. Therefore, the solid component combustion brightness is estimated by using the following methods.

In one of the methods, the brightness distribution of the solid component combustion distribution is approximated to a brightness distribution extending along the center line of the flame. It is a section of the flame including the volatile component combustion regions which are distanced from the burner by about $X/D=0\sim2$ that constitutes the object of processing. In this section of the flame, the combustion speed of the solid component is lower than that of the volatile component, so that the combustion of the volatile component far surpasses that of the solid component. Thus, no great deviation from the actual condition occurs even if the solid component combustion brightness in the oxidization regions and volatile component combustion regions is approximately shown by the brightness distribution along the center line of the flame.

Another method consists in correcting the brightness distribution along the center line of the flame and using the corrected brightness distribution as a brightness distribution of the solid component combustion brightness, to improve the accuracy of the information on the volatile component combustion regions. Let the brightness distribution along the center line of the flame be denoted by Ro (x). A brightness distribution of the solid component combustion brightness RC (x, y) at a distance y from the center line is approximated by the following equation:

$$Rc(x, y)=K(y)\times Rn\ (x) \qquad (1')$$

where K(y): the coefficient of correction.

Various processes may be performed for setting $K(o)=1.0$, $Rc\ (x, o)=Ro\ (x)$ and the coefficient of correction K(y) in the center of the flame. One of the processes will be discussed hereinafter.

An image of the flame produced by the combustion of pulverized coal is obtained by means of the image fibers IF and converted into electrical signals by an image forming camera to produce a picture of a flame as shown in FIG. 5B1. The image thus produced is stored in a memory of a flame image input device. FIG. 5B1 shows image data on all the area of the image obtained by the image fibers IF. By performing what is referred to as a cut-off process, image data on the area of the image disposed in the vicinity of the burner (shown in a square block in FIG. 5B1) which constitutes the object of the cut-off process is separated from the rest of the image and fed into a flame image processing unit. The cut-off process is performed in order to restrict the image data to such an extent that the relation expressed by the formula (1') approximately holds, to eliminate the influences which might otherwise be exerted by the rest of the burner regions on the result obtained, and to reduce the data to a size which is determined by the time required for performing operations by the flame image processing device and the capacity of the memory. FIG. 5B2 shows an image of the flame obtained by performing the cut-off process. Then, the image data obtained by the cut-off process is rotated to facilitate processing to which the image data is subsequently to be subjected and to enable the image data to be readily recognized when it is displayed as by a cathode-ray display unit. Various processes may be available for rotating the image data. One of them will be discussed hereinafter. In this process, the image data is subjected to an affine transformation as follows:

$$\begin{pmatrix} u \\ v \end{pmatrix} = \begin{pmatrix} a & b \\ c & d \end{pmatrix} \begin{pmatrix} x \\ y \end{pmatrix} + \begin{pmatrix} u_o \\ v_o \end{pmatrix} \tag{2'}$$

where $\begin{pmatrix} u \\ v \end{pmatrix}$ :

the coordinates after the transformation.

$\begin{pmatrix} a & b \\ c & d \end{pmatrix}$ :

the transformation matrix.

$\begin{pmatrix} x \\ y \end{pmatrix}$ :

the coordinates before the transformation.

$\begin{pmatrix} u_o \\ v_o \end{pmatrix}$ :

the constant

After subjecting the image data shown in FIG. 5B2 to the rotation treatment as aforesaid, image data shown in FIG. 5B3 is obtained. FIG. 5B4 shows the brightness distribution of the image data obtained by rotating the image data shown in FIG. 5B2. It will be seen that the brightness increases in going rightwardly in the figure away from the burner. FIG. 5B4' shows brightness distributions taken along the lines C–C' and D–D' in FIG. 5B4. Then, a flame portion is separated from a burner portion and a furnace wall portion in the image data to provide a flame zone. The purpose of this operation is to avoid any error which might otherwise occur in the form of a noise when the image data is subjected to further processing because, if the reduction region of the flame has a lower brightness than the furnace wall portion, the furnace wall portion would be recognized by mistake as a flame. The flame region can be readily separated by using a threshold processing process whereby image data below a given level is replaced by image data of zero brightness. The brightness of each picture element of the image data IP (i, j) is determined as follows with respect to the threshold value t:

$$JP(i, j) = \begin{cases} IP(i, j), \text{ when } IP(i, j) > t \\ O, \text{ when } IP(i, j) \leqq t \end{cases} \tag{3'}$$

In setting the threshold value, the threshold value may be fixed at a constant brightness level in light of the brightness distribution of the image pattern or a brightness level matching the combustion pattern when the fuel-air mixture combusted in the furnace is constant in volume or the combustion in the furnace follows one pattern. However, when the volume of the fuel-air mixture combusted in the furnace fluctuates greatly or irregularly, it is difficult to keep the threshold value constant. When this is the case, the threshold value is set as follows. First, an area occupied by the flame zone is set. Then, the frequency (which corresponds to the area) of each brightness level is calculated based on the image data, and the frequencies of brightness levels are added when the brightness of the image data reaches a maximum value. When the result obtained by the addition exceeds the initially set area (the area of the flame zone), the brightness level prevailing at that time is used as a threshold value. When this process is employed, the threshold value can be renewed and set at a suitable level, so that it is possible to process the image data without being affected by a variation in the volume of the fuel-air mixture combusted in the furnace.

Figure 6:
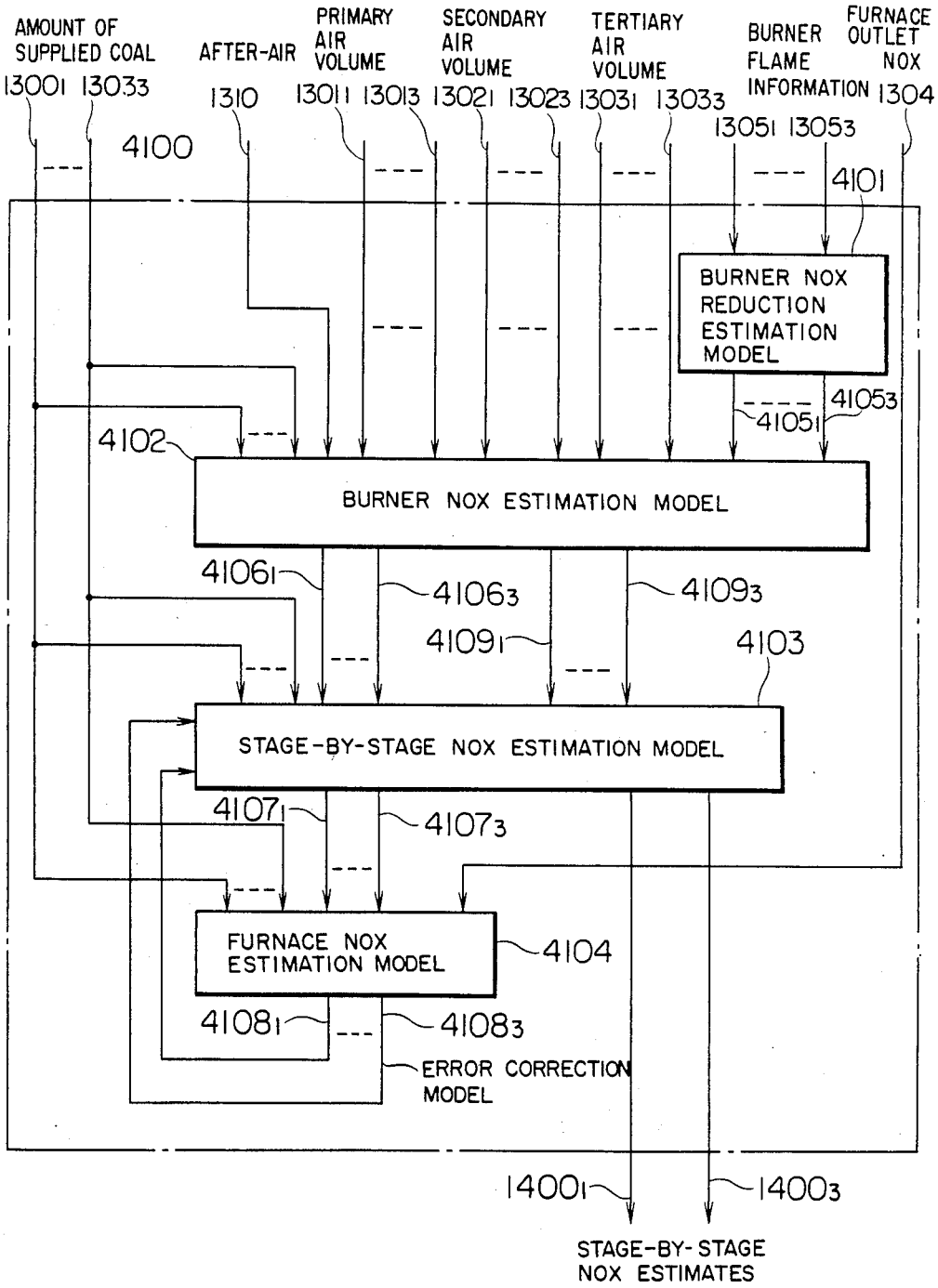
FIG. 6 is a view in explanation of the stage-by-stage nitrogen oxides estimation function block.

FIG. 5B5 shows image data obtained by processing the image data of the flame by using a threshold value, and FIG. 5B6 shows the brightness distribution of the image data shown in FIG. 5B5. FIG. 5B6' shows brightness distributions in sections taken along the lines C–C' and D–D' in FIG. 5B6.

Then, information is obtained on the shape and brightness distribution of the volatile component combustion regions in the oxidization regions in the flame based on the flame image data obtained by performing processing with a threshold value. In separating the oxidization regions from the rest of the flame, difficulties would be experienced in achieving the desired result if processing were performed by using a given threshold value, because the brightness increases both in the oxidization regions and in the reduction region in going rightwardly in FIG. 5B6 away from the burner, as can be clearly seen in the brightness distribution shown in FIG. 5B6. Therefore, one only has to subject the flame image to transformation by using the brightness level of the reducing region of the flame as a reference, in view of the fact that, as shown in FIG. 5A1, the combustion taking place in the oxidization regions is combustion of the solid component and the volatile component of the pulverized coal and the combustion taking place in the reduction region in the central portion of the flame is combustion of the solid component. Stated differently, the volatile component combustion regions in the oxidization regions can be separated to obtain information thereon by subjecting the flame image to brightness conversion whereby the brightness of the oxidization regions of the flame is converted into a relative brightness level with respect to the brightness level of the reduction region in the flame.

The process noted hereinabove will be described in concrete terms. As a reference, the brightness distribution in the center of the reduction region (the brightness distribution along the line C–C' in FIG. 5B6) is used, and the brightness of the oxidization regions is converted in the Y-axis direction into the relative brightness with respect to the reference brightness at the X-axis coordinate.

$$R^*(i, j) = R(i, j) - Rc(i, j) \quad (4')$$

where

R (i, j): the brightness before the conversion.

R*(i, j): the brightness after the conversion.

Rc(i, j): the reference brightness.

i, j: the X-axis and Y-axis coordinates.

The reference brightness Rc (i, j) can be given by the following equation:

$$Rc(i, j) = K(j) \times Ro(i) \quad (5')$$

where

K (j): the coefficient of correction.

Ro(i): the brightness in the center line of the flame.

The coefficient of correction K(j) is intended to correct the brightness distribution of the solid component combustion in the Y-axis direction from the center line of the flame. The coefficient of correction K(j) is calculated by the following equation based on the brightness of a region (located on the rightmost end of the image data which is farthest from the burner) in which the combustion of the volatile component has finished and only the solid component is burning.

$$K(j) = \frac{R(i_{max}, j)}{Ro(i_{max})} \quad (6')$$

where $i_{max}$: the maximum value of the X-axis coordinate.

By setting the length of the image data at a value substantially equal to the distance X/D=2 from the burner, it is possible to approximate the brightness distribution of the combustion of the solid component with a high degree of accuracy by performing correction by using the coefficient of correction K (j) shown in the equation (6'), because the portion of the image data near its right end is free from the influences of the combustion of the volatile component and shows only the brightness of combustion of the solid component, as shown in FIG. 5A2.

Figure 8:
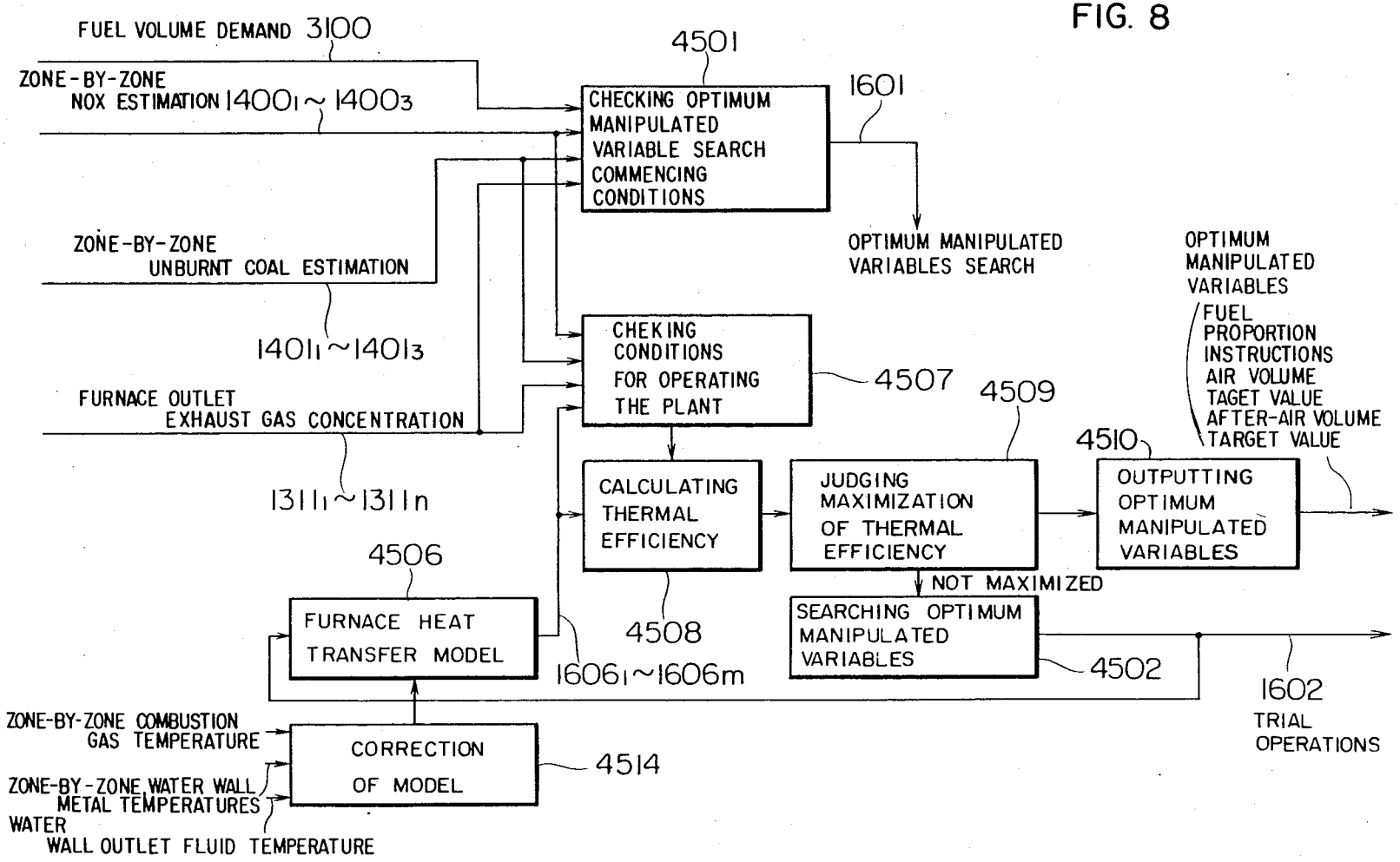

The result achieved in separating the volatile component combustion regions by using the process of converting the brightness is shown in FIG. 5B7. FIG. 5B8 shows the brightness distribution of the volatile component combustion regions shown in FIG. 5B7, and FIG. 5B8' shows the brightness distribution taken along the line D–D' in FIG. 5B8.

Thus, it is possible to obtain information on the shape and brightness of the volatile component combustion regions in the oxidization region of the flame by converting the brightness of the flame image data at the brightness level of the reduction region of the flame based on the fact that, when pulverized coal is burned, the solid component and volatile component of the coal are burned, the combustion of both the solid component and the volatile component takes place in the oxidization regions and only the solid component burns in the reduction region.

FIG. 6 shows one constructional form of the stage-by-stage nitrogen oxides estimation function block 4100. In a nitrogen oxides reduction estimation model 4101, calculation is done on flame characteristic parameters of the separate stages based on the burner flame information 1305$_1$–1305$_3$ of the respective burner stages, and estimates are made on burner nitrogen oxides reductions 4105$_1$–4105$_3$ as functions of the parameters. The details are described in Japanese Patent Application No. 92872/84 entitled "Combustion Condition Monitoring Apparatus". In a burner nitrogen oxides estimation model 4102, burner stage-by-stage air ratios 4109$_1$–4109$_3$ are obtained based on the volumes of supplied coal 1300$_1$–1300$_3$, the volumes of primary air 1301$_1$–1301$_3$, the volumes of secondary air 1302$_1$–1302$_3$ and the volumes of tertiary air 1303$_1$–1303$_3$ supplied to separate stages of the burner as well as the after-air 1310, and estimates are made of the amounts of the nitrogen produced in the burner before they show a reduction. Then, estimates are made on burner nitrogen oxides concentrations 4106$_1$–4106$_3$ by deducting the burner nitrogen oxides reductions 4105$_1$–4105$_3$ from the amounts of the nitrogen oxides produced in the burner. In a stage-by-stage nitrogen oxides estimation model 4103, calculation is done on stage-by-stage nitrogen oxides estimates 4107$_1$–4107$_3$ by using the stage-by-stage burner air ratios 4109$_1$–4109$_3$ and a burner mean air ratio based on a model which takes into consideration the effects achieved in reducing the nitrogen oxides in the furnace and regenerating the nitrogen oxides by air introduced through the NO port with respect to the burner nitrogen oxides concentrations 4106$_1$–4106$_3$. In a furnace nitrogen oxide estimation model 4104, calculation is done on stage-by-stage nitrogen oxides estimates 1400$_1$ to 1400$_3$ by correcting primary estimates of the stage-by-stage nitrogen oxides obtained in the stage-by-stage nitrogen oxides estimation model 4103 by error correction signals 4108$_1$ to 4108$_3$ by using the furnace outlet nitrogen oxides measured values 1304. The details of the stage-by-stage nitrogen oxides estimation model 4103 and furnace nitrogen oxides estimation model 4104 are described in Japanese Patent Application No. 118296/84.

The stage-by-stage unburned-coal-in-the-ash estimation function block 4200 will be described by referring to FIGS. 6A1 and 6A2.

In a logical and arithmetic operations block 5000, an operation is performed to obtain an unburned-coal-in-the-ash estimation index $I_{UBC}$ based on the two-dimensional high and low density image signals 1306$_1$–1306$_3$. The $I_{UBC}$ can be obtained by the following equation:

$$I_{UBC} = K \cdot (dz/dB)^{-1} (dx/dB)^{-1} A_1$$

where dz: the distance between the oxidization regions in the flame of combustion in the furnace and the forward end of the burner.

dx: the spacing interval between the oxidization regions.

Ax: the volume of primary air.

dB: the diameter of the burner.

K: the constant. FIG. 6A2 shows the relation between the burner outlet and the oxidization regions.

The values of the index estimates obtained are fed into an unburned-coal-in-the-ash estimation block 4210 to obtain an estimate of the amount of the unburned coal in the ash for the burner as a whole. Based on this estimate, the amounts of the stage-by-stage unburned coal in the ash are estimated in a stage-by-stage unburned-coal-in-the-ash estimation block 4220.

In FIG. 6A2, $G_1$ and $G_2$ designate the centers of gravity of the oxidization regions of the flame.

FIG. 7 shows one constructional form of the stage-by-stage fuel/air proportion calculation function block 4500. The operation of this block will be described by referring to FIG. 7. In an optimum manipulated variables search commencement condition checking section 4501, the fuel amount requirement 3100, stage-by-stage nitrogen oxides estimates $\mathbf{1400_1}$–$\mathbf{1400_3}$, stage-by-stage unburned-coal-in-the-ash estimates $\mathbf{1401_1}$–$\mathbf{1401_3}$ and furnace outlet exhaust gas concentrations $\mathbf{1311_1}$–$\mathbf{1311_3}$ are periodically compared with predetermined values, and when the predetermined values are not exceeded, the fuel proportion instructions $\mathbf{3310_1}$–$\mathbf{3310_3}$, primary air volume target values $\mathbf{3320_1}$–$\mathbf{3320_3}$, secondary air volume target values $\mathbf{3330_1}$–$\mathbf{3330_3}$, tertiary air volume target values $\mathbf{3340_1}$–$\mathbf{3340_3}$ and after-air volume target value 3350 calculated previously are outputted. The instructions and target values noted hereinabove will hereinafter be referred to as manipulated variables. However, when any of the values has exceeded the predetermined value, an optimum manipulated variables search instructions 1601 are issued to commence a search for new values for the manipulated variables. More specifically, the search instructions 1601 cause an optimum manipulated variables search section 4502 to perform a trial search 1602 on each of a stage-by-stage nitrogen oxides prediction model 4503, a stage-by-stage unburned-coal- in-the-ash prediction model 4504 and a furnace outlet exhaust gas concentration prediction model 4505, so that calculation is done in the respective models to provide predictions or stage-by-stage nitrogen oxides predictions $\mathbf{1603_1}$–$\mathbf{1603_3}$, stage-by-stage unburned-coal-in-the-ash predictions $\mathbf{1604_1}$–$\mathbf{1604_3}$, furnace outlet exhaust gas concentration predictions $\mathbf{1605_1}$–$\mathbf{1605_3}$ and furnace heat transfer model outputs $\mathbf{1606_1}$–$\mathbf{1606_3}$. In an operation restriction conditions checking section 4507, the operation to check whether or not the requirements for operating the plant are satisfied is performed with regard to the predictions that have been obtained as described hereinabove. If the requirements are not satisfied, calculation by trial operation is repeatedly performed. When the requirements are satisfied, boiler thermal efficiency is calculated based on furnace heat transfer model outputs $\mathbf{1606_1}$–$\mathbf{1606_3}$ in a thermal efficiency calculation section 4508. In a thermal efficiency maximization judging section 4509, judgment is passed as to whether the calculated boiler thermal efficiency has been maximized. When it is not maximized yet, the aforesaid trial operation is repeatedly performed. When the boiler thermal efficiency has reached a highest level, manipulated variables commensurate with the highest value of the boiler thermal efficiency are outputted via an optimum manipulated variables output section 4510 as optimum manipulated variables. Japanese Patent Application No. 80932/81 entitled "Method of Monitoring and Controlling Boiler Combustion Conditions" describes a process whereby the stage-by-stage nitrogen oxides prediction model 4503, stage-by-stage unburned-coal-in-the-ash prediction model 4504 and furnace outlet exhaust gas concentration prediction model 4505 can be constructed by using a process of multiple regression analysis.

When this process is used, it is possible to perform multiple regression analysis and correct the models by using the optimum manipulated variables and the stage-by-stage nitrogen oxides estimates $\mathbf{1400_1}$–$\mathbf{1400_3}$, the optimum manipulated variables and the stage-by-stage non-combusted components estimates $\mathbf{1401_1}$–$\mathbf{1401_3}$, and the optimum manipulated variables and furnace outlet exhaust gas concentrations $\mathbf{1311_1}$–$\mathbf{1311_n}$, the former serving as explanation variables and the latter serving as dependent variables. Thus, it is possible to cause the models to conform to changes in the characteristics of the furnace. With regard to the furnace heat transfer model 4506, it is also possible to correct the model by using the optimum manipulated variables and accumulated data about combustion gas temperature estimates $\mathbf{1402_1}$–$\mathbf{1402_5}$, water wall metal temperatures $\mathbf{1309_1}$–$\mathbf{1309_5}$ and a water wall outlet fluid temperature 1308 which correspond to the optimum manipulated variables, to thereby cause the furnace model to conform to the furnace characteristics.

FIG. 8 shows another constructional form of the stage-by-stage fuel/air proportion calculation function block 4500. In this constructional form, the stage-by-stage nitrogen oxides prediction model 4503, stage-by-stage unburned-coal-in-the-ash prediction model 4504 and furnace outlet exhaust gas concentration prediction model 4505 are not used, and the trial operation 1602 is directly outputted to the processor to enable the operation restriction conditions checking section 4507 to perform the operation of checking whether the requirements for operating the plant are satisfied based on signals from the processor in reply to the trial operation 1602. These are the differences between the constructional forms shown in FIGS. 7 and 8. The procedures performed in the constructional form shown in FIG. 8 for outputting optimum manipulated variables are similar to those of FIG. 7.

Figure 9:
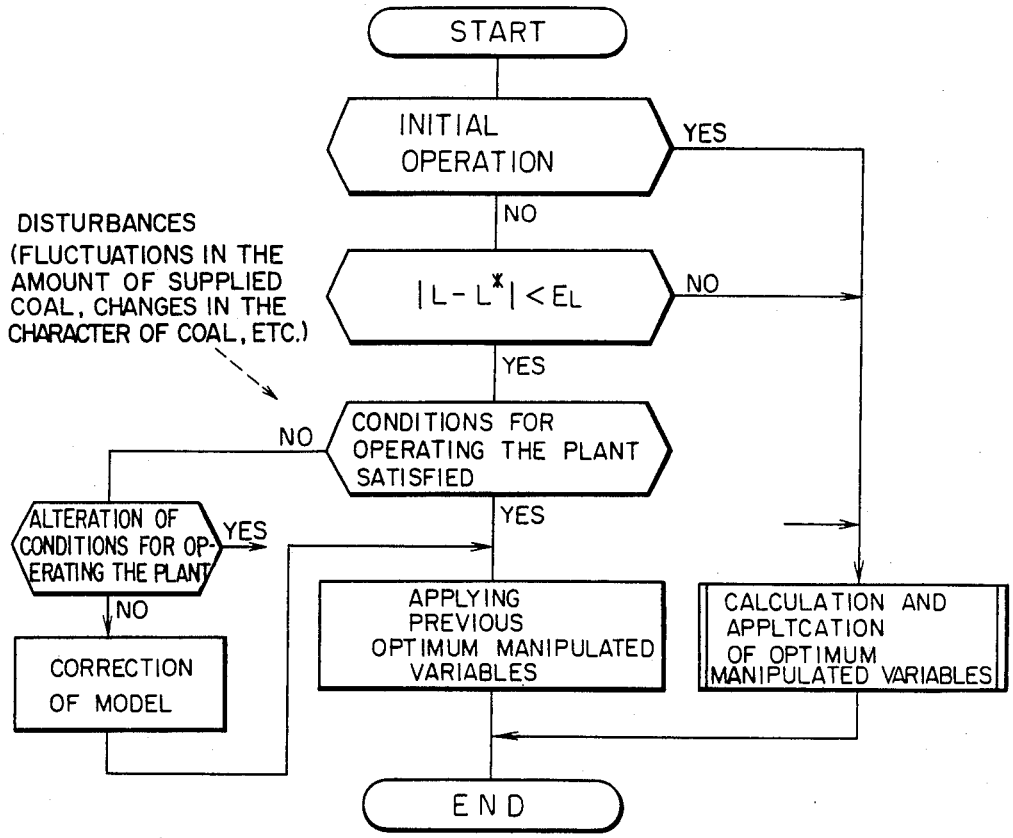
FIG. 9 is a view in explanation of the operation of the stage-by-stage fuel/air proportion calculation function block shown in FIG. 8.
Figure 10:
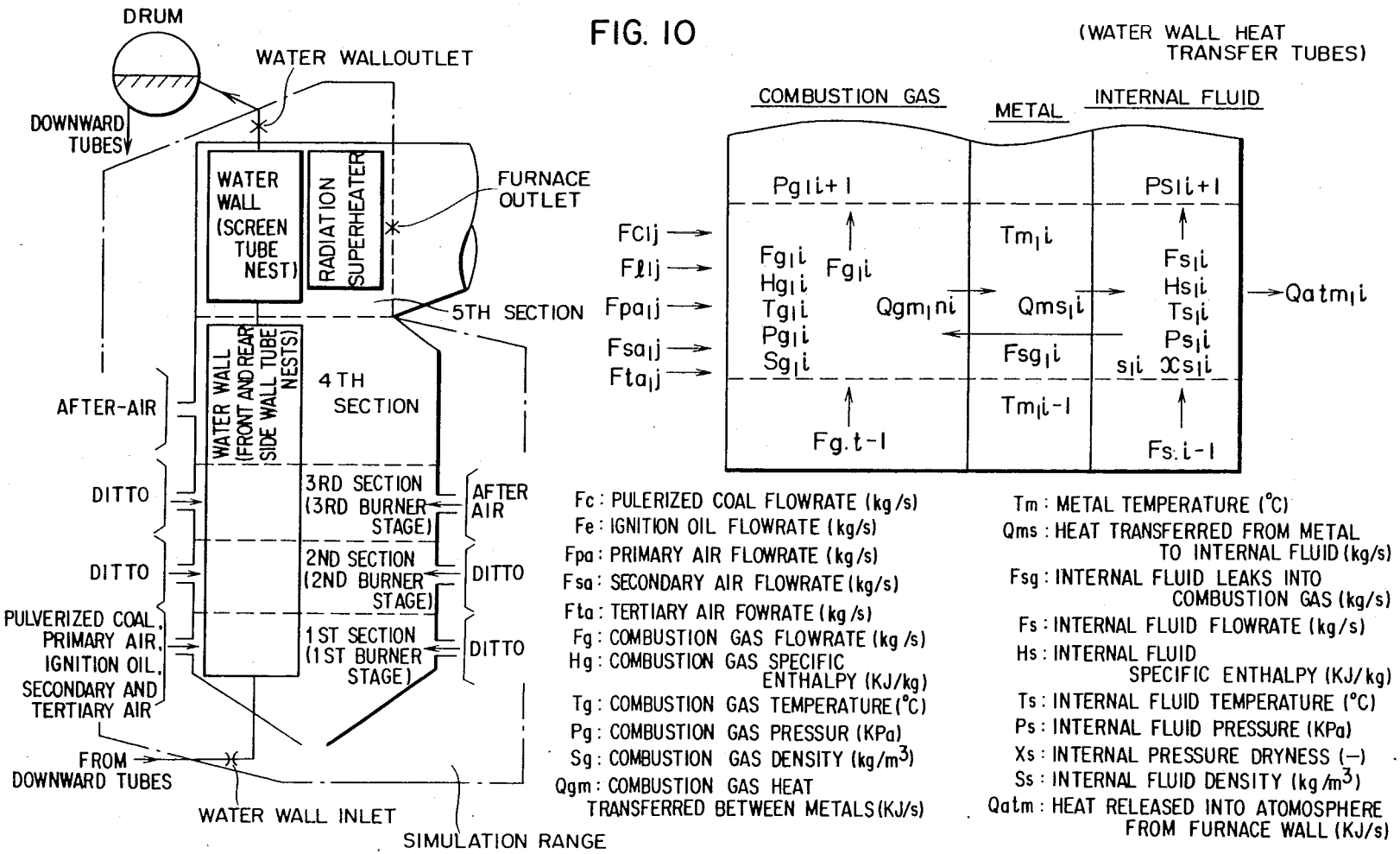
FIG. 10 is a view in explanation of the furnace heat transfer model.

FIG. 9 shows a flow chart of the operation performed by the stage-by-stage fuel/air proportion calculation function block 4500. When the system is carried into practice for the first time, optimum manipulated variables are calculated and outputted in accordance with the aforesaid procedures. In a second and later operations, a current fuel requirement L is compared with a fuel requirement L* obtained at the time when the optimum manipulated variables were calculated at the last time to find a difference between them when the absolute value of the difference exceeds a predetermined value $\epsilon_1$, optimum manipulated variables are calculated again because the maximum efficiency might not be achieved when the current manipulated variables were used. When the difference between the fuel requirements is below the predetermined value $\epsilon_1$, it is checked by the optimum manipulated variables search commencement condition checking section 4501 whether the requirements for operating the plant, such as the furnace outlet nitrogen oxides concentrations, are satisfied. If the requirements are satisfied, then the optimum manipulated variables of the last time are further used. If the requirements are not satisfied, then it is checked whether the requirements or conditions for operating the plant, such as the upper limit of the furnace outlet nitrogen oxides concentrations, have been changed as compared with the operation performed with the manipulated variables of the last time. When it is found that there has been a change in the conditions, new manipulated variables are searched. When there is no change, the difference between the fuel requirements is considered to be due to an estimation error committed by an estimation model, and the coefficient of the estimation model concerned (which may be the estimation model of the stage-by-stage nitrogen oxides estimation function block 4100 when the furnace outlet nitrogen oxides estimate does not meet the requirement for operating the plant, for example) is corrected based on the associated processing data by the process of multiple regression analysis. In this case, the manipulated variables calculated at the last time are continuously outputted. Before describing the search algorithm concerning the optimum manipulated variables shown in FIG. 9, a furnace heat transfer model used for checking the requirements or conditions for operating the plant and calculating thermal efficiency will be described. FIG. 10 shows a furnace heat transfer model for a burner for burning pulverized coal in which the furnace is split into five sections in a vertical upward direction (the direction of flow of combustion gas) and all the sections are approximated by using a system of concentrated constants. FIG. 10 shows processes of flow and heat transfer for the combustion gas in the furnace, the metal of heat-transfer tubes of the water wall (hereinafter metal), and the fluid inside the heat-transfer tubes (hereinafter internal fluid). The relation between the amounts of these processes is defined by a non-linear physical model based on the laws of preservation of the mass, momentum and energy. The constants of the combustion gas and internal fluid are smaller at the time of flow than at the time of heat-transfer. Therefore, the flow characteristics of the combustion gas and internal fluid are regarded as a constant flow (a fluid flow in which no acceleration occurs) and approximated by static characteristics.

Notations used for writing equations will be described.

(1) Characters

F: the flowrate of mass (kg/s).
P: the pressure (KPa).
T: the temperature (° C.)
H: the specific enthalpy, generated heat (KJ/Kg).
Q: the retained heat, transferred heat (KJ/s).
U: the rate of heat flow [KJ/(s.m$^2$)].
$\rho$: the density (Kg/m$^3$).
$\alpha$: the convection heat transfer rate [KJ/(m$^2$.° C.s)].
$\beta$: the radiation heat transfer rate [KJ/(m$^2$.(k/1000).s)].
C: the constant pressure specific heat [KJ/(Kg.° C.)].
X: the degree of dryness (−).
W: the water content (−) of the coal.
N: the ash content (−) of the coal.
$\mu$: the excess air rate (−), the concentration (%).
$\epsilon$: the rate of passage of floating ash through the furnace outlet.
$\lambda$: the friction coefficient of the path of flow (−).
k: the specific combustion rate (−).
g: the gravity acceleration (m/s$^2$).
A: the heat-transfer area, the cross-sectional area of the path of flow (m$^2$).
R: the gas constant [Kg.m/(Kg.k)].
D: the diameter of the path of flow (m).
V: the volume of the path of flow (m$^3$).
$K_T$: the coefficient of the overall influences exerted by the composition of the combustion gas on the gas temperature (−).
$\Delta Z$: the length of the path of flow, the difference in the head of the path of flow (m).
$K_R$: the coefficient of the overall influences exerted by the composition of the combustion gas on the gas constant (−).
K: the coefficient for approximating the relation between the composition of the combustion gas and $K_T$ and $K_R$ (−).
$\phi$: the shape coefficient relating to the radiation heat transfer between the combustion gas and the heat-transfer tube metal in separate sections of the furnace (−).

(2) Subscripts (i) Subscripts showing the relation between the substances g: the combustion gas.
m: the heat-transfer tube metal.
s: the internal fluid of the heat-transfer tubes.
c: the pulverized coal.
l: the ignition oil
$p^a$: the primary air (pulverized coal transporting air).
$s^a$: the secondary air.
$t^a$: the tertiary air.
f: the body heated by combustion.
gm: the transfer of heat from the combustion gas to the heat-transfer tube metal.
ms: the transfer of heat from the heat-transfer tube metal to the internal fluid.
sg: the flow and transfer of heat from the internal fluid of the heat-transfer tubes to the combustion gas.
ash: the ash.
a: the total air flowing into the furnace.
ao: the air necessary for subjecting the fuel flowing into the furnace to complete combustion.
atm: the atmosphere.
O: the excess oxygen in the combustion gas.

(ii) Subscripts designating the location i: the section of the furnace.
i (1): the front of the i section of the furnace.
i(2): the rear of the i section of the furnace.
in: the combustion gas in the i section and the heat-transfer tube metal in all the sections.
ni: the combustion gas in all the sections and the heat-transfer metal in the i section.
j: burner stages.
SH: the radiation heat superheater.
F: the interior of the furnace.
FX: the downstream portion of the furnace outlet.
SH(1): the combustion gas contacting portion of the radiation heat superheater.
SH(2): the radiation heat receiving portion of the radiation heat superheater.

(iii) Subscripts designating changes in the reference value, state, etc.

gr: the reference value of the quantity of state concerning combustion gas.
sr: the reference value of the quantity of state concerning the internal fluid of the heat-transfer tubes.
r: the reference value concerning the composition of the fuel and combustion gas.
gv: the quantity of state concerning the evaporation and super-heating of water.
gmr: the reference value concerning the transfer of heat from the combustion gas to the heat-transfer tube metal.
msr: the reference value concerning the transfer of heat from the heat-transfer tube metal to the internal fluid.

SB: the quantity of state of the subcooling boiling commencing point.

The equations dealing with the furnace models will now be discussed.

1. The Heat Input and Heat Generation Characteristics Model of Fuel and Air (1) The Amount of Heat Generated by Combustion $$F_{c,ji} = K_{ji}(1 \geqq K_{ji} \geqq 0,\ i \geqq j) \tag{1}$$

$$F_{c,i} = \sum_{i=1}^{3} K_{ji} \cdot F_{c,j} \tag{2}$$

$$F_{cj} = \sum_{m=1}^{2} F_{c,j}(m) \tag{3}$$

$$Q_{f,i} = F_{c,j} \cdot H_c\left(1 - \frac{\Delta H_c}{H_c}\right) + F_{l,i} \cdot H_f(i = j) \tag{4}$$

$$Q_{f,i} = F_{c,j} \cdot H_c\left(1 - \frac{\Delta H_c}{H_c}\right)\ (i \neq j) \tag{5}$$

(2) The Amount of Heat Retained in the Fuel and Air $$Q_{c,i} = \sum_{m=1}^{2}\left[C_c(T_{c,i(m)} - T_{atm,B})\left\{1 - W\left(1 - \frac{\Delta W}{W}\right)\right\} F_{c,i(m)} + C_w(T_{c,i(m)} - T_{atm,B}) \cdot W\left(1 - \frac{\Delta W}{W}\right) \cdot F_{c,i(m)}\right]\ (i = j) \tag{6}$$

$$Q_{l,i} = C_l \cdot (T_l - T_{atm,B}) \cdot F_{l,i}(i = j) \tag{7}$$

$$Q_{pa,i} = \sum_{m=1}^{2} \{C_a(T_{c,i(m)} - T_{atm,B}) \cdot F_{pa,i(m)}\}(i = j) \tag{8}$$

$$Q_{sa,i} = C_a(T_{sa} - T_{atm,B})F_{sa,i} \tag{9}$$

$$Q_{ta,i} = C_a(T_{ta} - T_{atm,B})F_{ta,i} \tag{10}$$

(2) The Heat Transfer and Flow Characteristics Model of the Combustion Gas 2.1 The Heat Transfer Characteristics of the Combustion Gas (1) The combustion Gas Temperature $$T_{g,i} = f_g(H_{g,i}) \cdot K_{T,F} \tag{11}$$

$$V_{g,i} \cdot \rho_{g,i} \cdot \frac{dH_{g,i}}{dt} = Q_{c,i} + Q_{l,1} + Q_{pa,i} + Q_{sa,i} + Q_{ta,i} + H_{g,i-1} \cdot F_{g,i-1} + H_{s,i} \cdot F_{sg,i} + Q_{f,i} - H_{g,i} \cdot F_{g,i} - Q_{gv,i} - Q_{gm,in}\ (i = j) \tag{12}$$

$$V_{g,i} \cdot \rho_{g,i} \cdot \frac{dH_{g,i}}{dt} = H_{g,i-1} \cdot F_{g,i-1} + H_{s,i} \cdot F_{sg,i} + Q_{f,i} - H_{g,i} \cdot F_{g,i} - Q_{gv,i} - Q_{gm,in}\ (i \neq j) \tag{13}$$

$$Q_{gv,i} = Hw\left[F_{c,i}\left\{w\left(1 - \frac{\Delta w}{w}\right) - w_r\right\} + (1 - X_{s,i})F_{sg,i}\right] + \left[F_{c,i}\left\{w\left(1 - \frac{\Delta w}{w}\right) - w_r\right\} + F_{sg,c}\right] \cdot C_s(T_{g,i} - T_{s,i})\ (i \neq j) \tag{14}$$

-continued $$Q_{gv,i} = H_w \cdot F_{sg,i}(1 - X_{s,i}) + C_s(T_{g,i} - T_{s,i})F_{sg,i}\ (i \neq j) \tag{15}$$

(2) The Amount of Heat transferred from the Combustion Gas to the Metal $$\alpha_{gm,i} = \alpha_{gm,r}\left(\frac{F_{g,i}}{F_{gr}}\right)^{0.6} \tag{16}$$

$$Q_{c,gm,i} = \alpha_{gm,i} \cdot A_{gm,i}(T_{g,i} - T_{m,i})\ (5 \geqq i \geqq 1) \tag{17}$$

$$Q_{c,gm,SH} = \alpha_{gm,i} \cdot A_{gm,SH}(T_{g,i} - T_{m,SH})\ (i = 5) \tag{18}$$

$$Q_{c,gm,in} = \sum_{n=1}^{5}\left[\beta_{gm}\left(1 - \frac{\Delta\beta_{gm}}{\beta_{gm}}\right) A_{gm,n} \cdot \phi_{in}\left\{\left(\frac{T_{g,i} + 273.2}{100}\right)^4 - \left(\frac{T_{m,n} + 273.2}{100}\right)^4\right\}\right] + \beta_{gm}\left(1 - \frac{\Delta\beta_{gm}}{\beta_{gm}}\right) A_{gm,SH(2)} \cdot \phi_{iSH}\left\{\left(\frac{T_{g,i} + 273.2}{100}\right)^4 - \left(\frac{T_{m,SH} + 273.2}{100}\right)^4\right\} \tag{19}$$

$$Q_{gm,in} = Q_{c,gm,i} + Q_{c,gm,in}\ (4 \geqq i \geqq 1) \tag{20}$$

$$Q_{gm,in} = Q_{c,gm,i} + Q_{c,gm,SH} + Q_{c,gm,in}\ (i = 5) \tag{21}$$

$$Q_{c,gm,ni} = \sum_{n=1}^{5}\left[\beta_{gm}\left(1 - \frac{\Delta\beta_{gm}}{\beta_{gm}}\right) A_{gm,i} \cdot \phi_{in}\left\{\left(\frac{T_{g,n} + 273.2}{100}\right)^4 - \left(\frac{T_{m,i} + 273.2}{100}\right)^4\right\}\right] \tag{22}$$

$$Q_{c,gm,SH} = \sum_{n=1}^{5}\left[\beta_{gm}\left(1 - \frac{\Delta\beta_{gm}}{\beta_{gm}}\right) A_{gm,SH(2)} \cdot \phi_{n,SH}\left\{\left(\frac{T_{g,n} + 273.2}{100}\right)^4 - \left(\frac{T_{m,SH} + 273.2}{100}\right)^4\right\}\right] \tag{23}$$

$$Q_{gm,ni} = Q_{c,gm,i} + Q_{c,gm,ni} \tag{24}$$

$$Q_{gm,SH} = Q_{c,gm,SH} + Q_{c,gm,SH} \tag{25}$$

2.2 The Flow Characteristics of the Combustion Gas (1) The flowrate of Combustion Gas $$F_{g,i} = F_{c,i} + F_{l,i} + F_{pa,i} + F_{sa,i} + F_{ta,i} + F_{sg,i} + F_{g,i-1}(i = j) \tag{26}$$

$$F_{g,i} = F_{c,i} + F_{sg,i} + F_{g,i-1}(i = j) \tag{27}$$

(2) The Pressure of Combustion Gas $$P_{g,i} = P_{g,i+1} + \frac{\lambda_g \cdot \Delta Z_{g,i} \cdot F_{g,i}^2}{2 \cdot D_{g,i} \cdot \rho_{g,i} \cdot A_{g,i}^2} + g \cdot \rho_{g,i} \cdot \Delta Z_{g,i} \quad (28)$$

$$\rho_{g,i} = \frac{P_{g,i}}{R(T_{g,i} + 273.2)} \quad (29)$$

From equations (28) and (29):

$$P_{g,i} = \frac{b + \sqrt{b^2 + 4ac}}{2a} \quad (30)$$

$$a = 1 - \frac{g \cdot \Delta Z_{g,i}}{R(T_{g,i} + 273.2)} \quad (31)$$

$$b = P_{g,i+1}$$

$$c = \frac{\lambda_g \cdot \Delta Z_{g,i} \cdot F_{g,i}^2}{2 \cdot D_{g,i} \cdot A_{g,i}^2} \cdot R(T_{g,i} + 273.2)$$

$$R = R_r \cdot K_{R,F} \quad (32)$$

3. The Heat Transfer and Flow Characteristics Model of the Metal and Internal Fluid 3.1 The Heat Transfer Characteristics of the Metal and Internal Fluid (1) The Temperature of Metal $$C_m \cdot M_{m,i} \frac{dT_{m,i}}{dt} = Q_{gm,ni} - Q_{ms,i} - Q_{atm,i} \quad (33)$$

(2) The Amount of Heat Transferred from Metal to Internal Fluid and Atmosphere $$\alpha_{ms,i} = \alpha_{msr} \cdot \left(\frac{F_{s,i}}{F_{sr}}\right)^{0.8} \cdot f_s(X_{s,i}, X_{SB,i}) \quad (34)$$

$f_s$: the coefficient of correction of the convection heat transfer rate between metal and internal fluid under the condition of two-phase flow.

$$Q_{ms,i} = \alpha_{ms,i} \cdot A_{ms,i}(T_{m,i} - T_{s,i}) \quad (35)$$

$$U_{ms,i} = Q_{ms,i}/A_{ms,i} \quad (36)$$

$$Q_{atm,i} = \alpha_{atm} \cdot A_{atm,i}(T_{m,i} - T_{atm}) \quad (37)$$

(3) The Temperature and Dryness of Internal Fluid $$V_{s,i} \cdot \rho_{s,i} \cdot \frac{dH_{s,i}}{dt} = Q_{ms,i} + H_{s,i-1} \cdot F_{s,i-1} - H_{s,i} \cdot F_{s,i} - H_{s,i} \cdot F_{sg,i} \quad (38)$$

$$X_{s,i} = f_{s2}(H_{s,i}, P_{s,i}) \quad (39)$$

$$T_{s,i} = f_{s3}(H_{s,i}, P_{s,i}) \quad (40)$$

3.2 The Flow Characteristics of Internal Fluid (1) The Pressure of Internal Fluid $$P_{s,i} = P_{s,i+1} + \frac{\lambda_s \cdot Z_{s,i}(F_{s,i} + F_{sg,i})^2}{2 \cdot D_{s,i} \cdot A_{s,i}^2 \cdot \rho_{s,i}} + g \cdot \rho_{si} \cdot \Delta Z_{si} \quad (41)$$

$$\rho_{si} = f_{s1}(H_{s,i}, P_{s,i}) \quad (42)$$

4. Furnace Multiple Unit Characteristics Model (1) The Excess Air Rate $$F_{c,F} = \sum_{j=1}^{3} F_{c,j} \quad (43)$$

$$F_{l,F} = \sum_{j=1}^{3} F_{l,j} \quad (44)$$

$$F_{a,F} = \sum_{j=1}^{3} (F_{pa,j} + F_{sa,j} + F_{ta,j}) \quad (45)$$

$$F_{a0} = K_{31} \cdot \left[ H_c \cdot \left(1 - \frac{\Delta H_c}{H_c}\right) + K_{32} \cdot \left\{ W_H - W \cdot \left(1 - \frac{\Delta W}{W}\right)\right\}\right] \cdot F_{c,F} + K_{33} \cdot F_{l,F} \quad (46)$$

$$\mu = F_{a,F}/F_{a,0} \quad (47)$$

The concentration of residual oxygen (wt %):

$$\mu_0 = 23.15\left(1 - \frac{1}{\mu}\right) \quad (48)$$

(2) The Flowrate of Combustion Gas at the Furnace Outlet $$F_{ash,F} = \nu \cdot F_{c,F} \quad (49)$$

$$F_{ash,FX} = \epsilon F_{ash,F} (0 \leqq \epsilon \leqq 1) \quad (50)$$

$$F_{g,FX} = F_{c,F}(1-\nu) + F_{ash,FX} + F_{a,F} \quad (51)$$

(3) The Coefficient of Influences Exerted by the Composition of Combustion gas $$K_{T,F} = 1 + K_{11}\left\{ W_r - W \cdot \left(1 - \frac{\Delta W}{W}\right)\right\} + K_{12} \cdot (\mu_r - \mu) + K_{13} \cdot (\nu_r - \nu) \quad (52)$$

$$K_{R,F} = 1 + K_{21} \cdot \left\{ W_r - W \cdot \left(1 - \frac{\Delta W}{W}\right)\right\} + K_{22} \cdot (\mu_r - \mu) + K_{33} \cdot (\nu_r - \nu) \quad (53)$$

$$K_{T,FX} = 1 + K_{11} \cdot \left\{ W_r - W \cdot \left(1 - \frac{\Delta W}{W}\right)\right\} + K_{12} \cdot (\mu_r - \mu) + K_{13} \cdot (\nu_r - \epsilon \cdot \nu) \quad (54)$$

$$K_{R,FX} = 1 + K_{21}\left\{ W_r - W\left(1 - \frac{\Delta W}{W}\right)\right\} + K_{12} \cdot (\mu_r - \mu) + K_{31} \cdot (\nu_r - \epsilon \cdot \nu) \quad (55)$$

Referring to FIG. 7 again, the furnace outlet nitrogen oxides prediction model 4503 will be described. Since it is difficult to describe physically the relation between the nitrogen oxides produced at the outlet of the furnace and the manipulated variables, it is paractical to use a statistical process, such as the process of multiple regression analysis. One example of the prediction model constructed in accordance with the process of multiple regression analysis will be described. In the multiple regression analysis process, the explanation variable and dependent variable are designated by $x_i$ ($i=1\sim m$) and y, respectively, and, when the functional relation $y=f(x_1, x_2 \ldots x_m) \ldots$ (56) holds between them, they are expressed by the following equation:

$$Y=\beta_0+\beta_1X_1+\beta_2X_2+\ \ldots\ +\beta_mX_m \tag{57}$$

so that the partial regression coefficients $\beta_0, \beta_1 \ldots \beta_m$ may be determined in a manner to minimize the deviation of Y from y. In the furnace outlet nitrogen oxides model, this process is employed to estimate the nitrogen oxides produced at each stage by the following equations:

$$\widetilde{NO}_{x1}=\beta_{01}+\beta_{11}\cdot x_1+\beta_{21}\cdot x_2+\ \ldots\ +\beta_{m1}\cdot x_m \tag{58}$$

$$\widetilde{NO}_{x2}=\beta_{02}+\beta_{12}\cdot x_1+\beta_{22}\cdot x_2+\ \ldots\ +\beta_{m2}\cdot x_m \tag{59}$$

$$\widetilde{NO}_{x3}=\beta_{03}+\beta_{13}\cdot x_1+\beta_{23}\cdot x_2+\ \ldots\ +\beta_{m3}\cdot x_m \tag{60}$$

where $x_1\sim x_m$: the manipulated variables.

$\beta_{0i}\sim\beta_{mi}$($i=1\sim3$): the partial regression coefficients.

Then the furnace outlet nitrogen oxides are estimated by the following equation:

$$\widetilde{NO}_{XFX}=\frac{F_{c,1}\cdot\widetilde{NO}_{x1}+F_{c,2}\cdot\widetilde{NO}_{x2}+F_{c,3}\cdot\widetilde{NO}_{x3}}{F_{c,1}+F_{c,2}+F_{c,3}} \tag{61}$$

where $F_{c,i}$: the flowrate of pulverized coal at stage i.

The stage-by-stage nitrogen oxides estimates 1400$_1$–1400$_3$ produced by the stage-by-stage nitrogen oxides estimation function block 4100 are used as data for determining the partial regression coefficients by the equations (58)–(60).

In the furnace outlet unburned-coal-in-the-ash prediction model 4504, stage-by-stage unburned-coal-in-the-ash predictions are obtained by the following equations in accordance with the process of multiple regression analysis in the same manner as described by referring to the furnace outlet nitrogen oxides prediction model 4503:

$$\widetilde{UBC}_1=\beta'_{01}+\beta'_{11}\cdot x_1+\beta'_{21}\cdot x_2+\ \ldots\ +\beta'_{m1}\cdot x_m \tag{63}$$

$$\widetilde{UBC}_2=\beta'_{02}+\beta'_{12}\cdot x_1+\beta'_{22}\cdot x_2+\ \ldots\ +\beta'_{m2}\cdot x_m \tag{63}$$

$$\widetilde{UBC}_3=\beta'_{03}+\beta'_{13}\cdot x_1+\beta'_{23}\cdot x_2+\ \ldots\ +\beta'_{m3}\cdot x_m \tag{64}$$

where $\beta'_{0i}\sim\beta'_{mi}$($i=1\sim3$): the partial regression coefficient.

Then, the furnace outlet unburned-coal-in-the-ash is predicted using the following equation:

$$\widetilde{UBC}_{FX}=\frac{F_{c,1}\cdot\widetilde{UBC}_1+F_{c,2}\cdot\widetilde{UBC}_2+F_{c,3}\cdot\widetilde{UBC}_3}{F_{c,1}+F_{c,2}+F_{c,3}} \tag{65}$$

The stage-by-stage unburned-coal-in-the-ash estimates 1401$_1$–1401$_3$ obtained by the stage-by-stage unburned-coal-in-the-ash estimation function block 4200 are used as stage-by-stage unburned-coal-in-the-ash data for determining the partial regression coefficients by the equations (62)–(64).

With regard to the furnace outlet exhaust gas concentration prediction block 4505, it is possible to estimate the concentration of CO, SO and ash at the outlet of the furnace by using the process of multiple regression analysis in the same manner as described with reference to the furnace outlet unburned-coal-in-the-ash prediction model 4504. However, in this case, it is impossible to estimate the concentration of exhaust gases for each stage of the furnace. Therefore, to obtain partial regression coefficients for the concentration of exhaust gases, the relation between the furnace outlet exhaust gas concentration estimate and the manipulated variables are made into a multiple regression model, and the values obtained by calculation on the concentrations of the exhaust gases are employed.

One constructional form of the operation restriction conditions checking section 4507 described by referring to FIGS. 7, 8 and 9 will now be described. In the interest of brevity, the requirement that should be met with regard to the exhaust gases will be omitted.

$$NOx_L \leqq NOx_{FX} \leqq NOx \tag{66}$$

$$X_2 = UBC_{FX} \leqq UBC_U \tag{67}$$

$$X_3 = -T_{g,FX} \leqq -T_{g,FXL} \tag{68}$$

$$\left.\begin{array}{l} X_4 = U_{gm,1} \leqq U_{gm,1U} \\ \quad\ \ \int \qquad\ \ \int \\ X_8 = U_{gm,5} \leqq U_{gm,5U} \end{array}\right\} \tag{69}$$

$$X_9 = U_{gm,SH} \leqq U_{gm,SHU} \tag{70}$$

where $NOx_{FX}$: the concentration of nitrogen oxides at the furnace outlet.

$UBC_{FX}$: the unburned-coal in the ash at the furnace outlet.

$NOx_U$: the upper limit of the concentration of nitrogen oxides at the furnace outlet.

$NOx_L$: the lower limit of the concentration of nitrogen oxides at the furnace outlet.

$UBC_U$: the upper limit of the unburned coal in the ash at the furnace outlet.

$T_{g,FX}$: the gas temperature at the furnace outlet.

$T_{g,FXU}$: the upper limit gas temperature at the furnace outlet.

$U_{gm,i}$: the rate of heat flow of the water wall metal in section i.

$U_{gm,1U}$: the upper limit of the rate of heat flow of the water wall metal of section i.

$U_{gm,SH}$: the rate of heat flow of the radiation superheater metal in section i.

$U_{gm,SHU}$: the upper limit of the rate of heat flow of the radiation superheater metal in section i.

When the temperature of air at the inlet of the denitriding device becomes too low, low temperature corrosion tends to occur in the metal of the denitriding device. The condition for avoiding this phenomenon is converted into the furnace outlet gas temperature by the equation (68). The equations (69) and (70) are for providing conditions for avoiding the burning of the metal.

One example of the requirements that should be met when the trial operation 1602 described by referring to FIGS. 7–9 is performed in determining the optimum manipulated variables is shown below $$\left.\begin{array}{l} F_{c,1L} \leqq X_{10}(=F_{c,1}) \leqq F_{c,1U} \\ F_{c,2L} \leqq X_{11}(=F_{c,2}) \leqq F_{c,2U} \\ F_{c,3L} \leqq X_{12}(F_{c,3}) \leqq F_{c,3U} \end{array}\right\} \quad (71)$$

$$\left.\begin{array}{l} F_{pa,1L} \leqq X_{13}(=F_{pa,1}) \leqq F_{pa,1U} \\ F_{pa,2L} \leqq X_{14}(=F_{pa,2}) \leqq F_{pa,2U} \\ F_{pa,3L} \leqq X_{15}(=F_{pa,3}) \leqq F_{pa,3U} \end{array}\right\} \quad (72)$$

$$\left.\begin{array}{l} F_{sa,1L} \leqq X_{16}(=F_{sa,1}) \leqq F_{sa,1U} \\ F_{sa,2L} \leqq X_{17}(=F_{sa,2}) \leqq F_{sa,2U} \\ F_{sa,3L} \leqq X_{18}(=F_{sa,3}) \leqq F_{sa,3U} \end{array}\right\} \quad (73)$$

$$\left.\begin{array}{l} F_{ta,1L} \leqq X_{19}(=F_{ta,1}) \leqq F_{ta,1U} \\ F_{ta,2L} \leqq X_{20}(=F_{ta,2}) \leqq F_{ta,2U} \\ F_{ta,3L} \leqq X_{21}(=F_{ta,3}) \leqq F_{sa,3U} \end{array}\right\} \quad (74)$$

$$F_{sa,4L} \leqq X_{22}(=F_{sa,4}) \leqq F_{sa,4U} \quad (75)$$

where $F_{c,i}$: the flowrate of pulverized coal in section i.

$F_{pa,i}$: the flowrate of primary air in section i.

$F_{sa,i}$: the flowrate of secondary air in section i.

$F_{ta,i}$: the flowrate of tertiary air in section i.

$F_{c,iU}$: the upper limit of the flowrate of pulverized coal in section i.

$F_{c,iL}$: the lower limit of the flowrate of pulverized coal in section i.

$F_{pa,iU}$: the upper limit of the flowrate of primary air in section i.

$F_{pa,iL}$: the lower limit of the flowrate of primary air in section i.

$F_{se,iU}$: the upper limit of the flowrate of secondary air in section i.

$F_{se,iL}$: the lower limit of the flowrate of secondary air in section i.

$F_{ta,iU}$: the upper limit of the flowrate of tertiary air in section i.

$F_{ta,iL}$: the lower limit of the flowrate of tertiary air in section i.

In the thermal efficiency calculation section 4508 shown in FIGS. 7 and 8, the thermal efficiency $\eta$ is defined as the ratio of the total heat in the entire area of the furnace including the generated heat and inputted heat to a portion of the total heat which is absorbed by the internal fluid through the water wall metal, and calculated by the following equation:

$$\eta = \frac{\sum_{i=1}^{5} Q_{ms,i} + Q_{ms,SH}}{\sum_{i=1}^{5} Q_{f,i} + \sum_{i=1}^{3} Q_{c,i} + \sum_{i=1}^{3} Q_{l,i} + \sum_{i=1}^{3} Q_{pa,i} + \sum_{i=1}^{4} Q_{sa,i} + \sum_{i=1}^{3} Q_{ta,i}} \times 100\% \quad (76)$$

where $Q_{ms,i}$: the amount of heat transferred to the internal fluid through the water wall metal in section i.

$Q_{ms,SH}$: the amount of heat transferred to the internal fluid through the radiation superheater metal.

$Q_{f,i}$: the amount of heat generated by the combustion of pulverized coal and ignition oil fuel.

$Q_{c,i}$: the amount of heat retained by pulverized coal in section i.

$Q_{l,i}$: the amount of heat retained by ignition oil.

$Q_{pa,i}$: the amount of heat retained by primary air in section i.

$Q_{sa,i}$: the amount of heat retained by secondary air in section i.

$Q_{ta,i}$: the amount of air retained by tertiary air in section i.

When the thermal efficiency $\eta$ is defined as the ratio of the total heat in the entire area of the furnace including the generated heat and inputted heat to a portion of the total heat which is absorbed by the metal, then calculation of the thermal efficiency is done by the equation (77):

$$\eta = \frac{\sum_{i=1}^{5} Q_{c,gm,i} + \sum_{i=1}^{5} Q_{c,gm,in} + Q_{c,gm,SH}}{\sum_{i=1}^{5} Q_{f,i} + \sum_{i=1}^{3} Q_{c,i} + \sum_{i=1}^{3} Q_{l,i} + \sum_{i=1}^{3} Q_{pa,i} + \sum_{i=1}^{3} Q_{sa,i} + \sum_{i=1}^{3} Q_{ta,i}} \times 100\% \quad (77)$$

where $Q_{c,gm,i}$: the amount of heat transferred by convection from the combustion gas in section i to the water wall metal (KJ/s).

$Q_{c,gm,in}$: the amount of heat transferred by radiation from the combustion gas in section i to the metal of a the water wall and radiation superheater in the entire area of the furnace (KJ/s).

$Q_{c,gm,SH}$: the amount of heat transmitted by convection from the combustion gas is section i to the radiation superheater metal (KJ/s).

One example of the process of calculation performed by the calculation section for calculating the optimum manipulated variables shown in the flow chart in FIG. 9 will be described.

Figure 11:
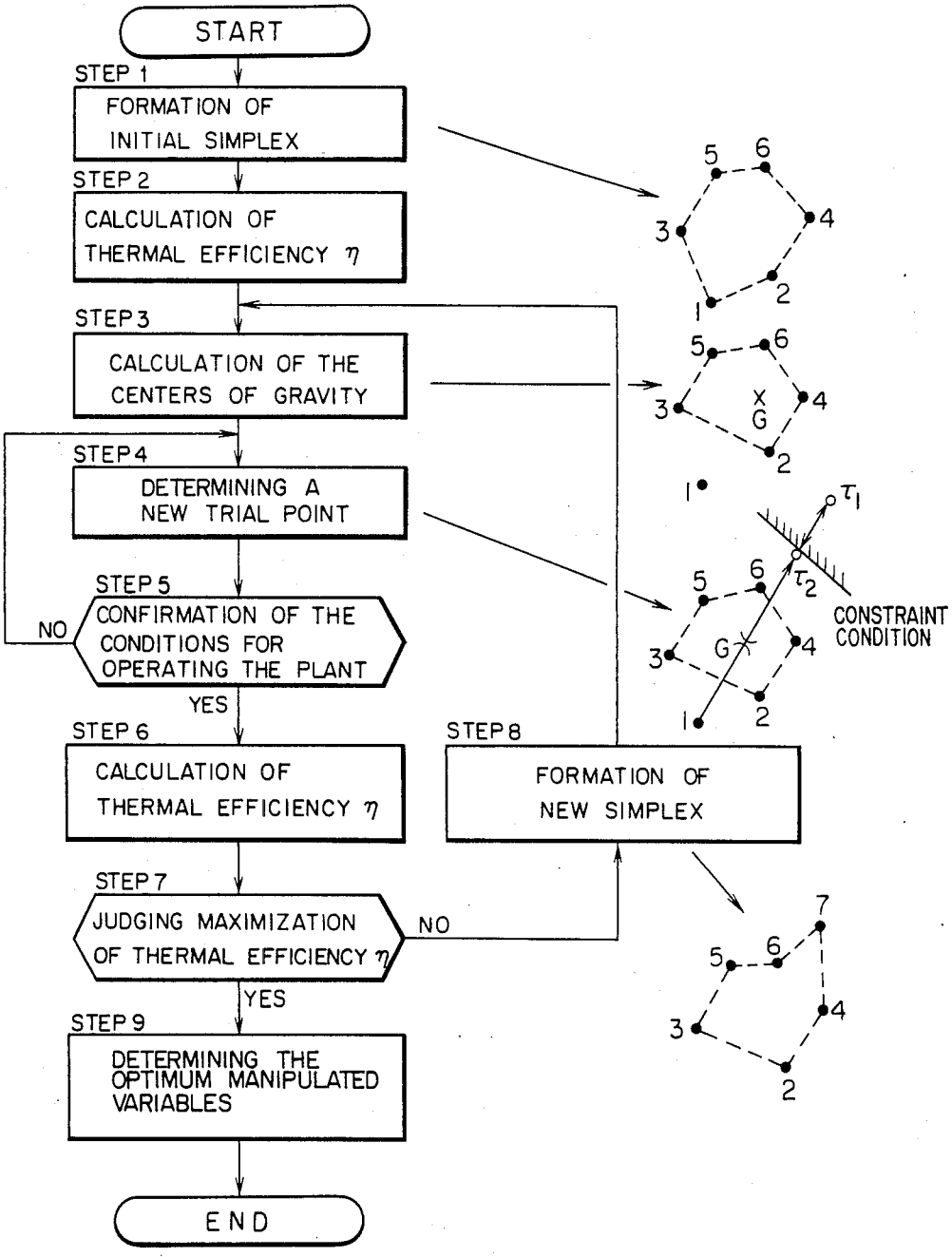
FIG. 11 shows one example of an algorithm for determining an optimum value for the stage-by-stage manipulated variable for the fuel/air proportion calculation function block.

FIG. 11 is a flow chart of an algorithm for determining optimum manipulated variables performed by using a complex, nonlinear planning process. This algorithm is for searching manipulated variables which maximize the thermal efficiency $\eta$ expressed by the equation (11) under the conditions for operating the plant expressed by the equations (66)–(75). This algorithm will be described by referring to FIG. 11.

(1) Step 1: Formation of Initial Simplex

An initial simplex is formed by using an initial trial point $X_i^1$ ($i=10\sim22$) which satisfies all the conditions for operating the plant expressed by the equations (71)–(75) and forming in a space defined by an operation vector X a polygon having angles which are K in number (in FIG. 11, K=6 in the interest of brevity, but K is preferably about twice the number of angles of the operation vector). In forming the initial simplex, one point is selected as the initial trial point $X_i^1$ and the rest of the points which are K−1 in number are determined by the following equation by using a uniform random number $r_j$ ($j=2\sim K$):

$$X_i^j = X1\min + r^j (Ximax - Ximin) \quad (78)$$

where $0 \leqq r^j \leqq 1$, and Ximin and Ximax are the lower limit and upper limit, respectively, of the manipulated variables shown by the equations (71)–(75). The initial trial point $X_i^j$ satisfies the conditions for operating the plant expressed by the equations (71)–(75) but does not necessarily satisfy the conditions expressed by the equations (66)–(70). When this is the case, the trial point is shifted toward the center of gravity of a point which is already determined to a position midway between the trial point and the center of gravity. In this way, all the points are finally determined.

(2) Step 2: Calculation of Thermal Efficiency $\eta$

Thermal efficiency is calculated by using the equation (11) with regard to all the points of the simplex constituted by the manipulated variables $X_i^j$ ($i=10\sim22$, $j=1\sim K$).

(3) Step 3: Calculation of the Centers of Gravity

The center of gravity of the simplex defined by the points of $(K-1)$ in number except for the point at which thermal efficiency is the lowest. When the point of the lowest efficiency $j=1$, $X_{Gi}$ can be expressed by the following formula:

$$X_{Gi} = \frac{\sum_{j=2}^{k} \eta^j X_i^j}{\sum_{j=2}^{k} \eta^j} \quad (79)$$

The distance $\Delta K_{Gi}$ from the point of the lowest efficiency to the center of gravity can be expressed by the following formula:

$$\Delta X_{Gi} = X_{Gi} - X_i^1 \quad (80)$$

(4) Step 4: Deciding a New Trial Point

The direction to be tried newly is set toward the center of gravity from the point of the lowest efficiency, and a new trial point is set at a position which is spaced apart from the center of gravity by a distance which is $\alpha_i$ times as great as the distance $\Delta X_{Gi}$ between the point of the lowest efficiency and the center of gravity. The new trial point is designated by $X_i^{k+1}$. When the new trial point is thus selected, it is considered appropriate empirically that the value of $\alpha_i$ expressed by the following equation has a value 1.3:

$$X_i^{k+1} = X_{Gi} + \alpha_i \Delta X_{Gi} \quad (81)$$

When the new trail point is found not to satisfy the equations (71)–(75) which set forth the conditions of the manipulated variables (as indicated by $7_1$ in the figure), the trail point is shifted to a position which satisfies the conditions for operating the plant (as indicated at $7_2$ in the figure).

(5) Step 5: Confirmation of the Conditions for Operating the Plant

When the new trail point does not satisfy the conditions for operating the plant as set forth by the equations (66)–(70), all the information concerning the trial point $X_i^{k+1}$ is rendered null, and the procedure returns to step 4 to decide a new trial point. In this case, the operation returns to step 4 after $\alpha_i$ is placed by $\alpha_i/2$.

(6) Step 6: Calculation of Thermal Efficiency $\eta$

The efficiency $\eta^{k+1}$ corresponding to the new trial point $X_i^{k+1}$ is calculated by using the equation (14).

(7) Step 7: Judging Maximization of Thermal Efficiency $\eta$

The highest and lowest values of thermal efficiencies for the new trial point and the points constituting the original simplex are designated by $\eta_{max}$ and $\eta_{min}$ respectively and the regulation value is set at $\epsilon_\eta$. Whether the efficiency has been maximized or not is judged by the following equation:

$$\frac{\eta_{max} - \eta_{min}}{\eta_{max}} < \epsilon_\eta \quad (82)$$

When the efficiency has reached the highest value, the operation shifts to step 9. If not, the operation shifts to step 8.

(8) Step 8: Formation of New Simplex

A new simplex is formed by points which are K in number by excluding the point of minimum efficiency from the points constituting the original simplex and adding the new trial point. Then, the operation returns to step 3.

(9) Step 9: Deciding the Optimum Manipulated Variables

When it is judged in step 7 that the thermal efficiency has achieved the highest value, manipulated variables that correspond to the maximum efficiency $\eta_{max}$ are used as optimum manipulated variables.

Figure 12:
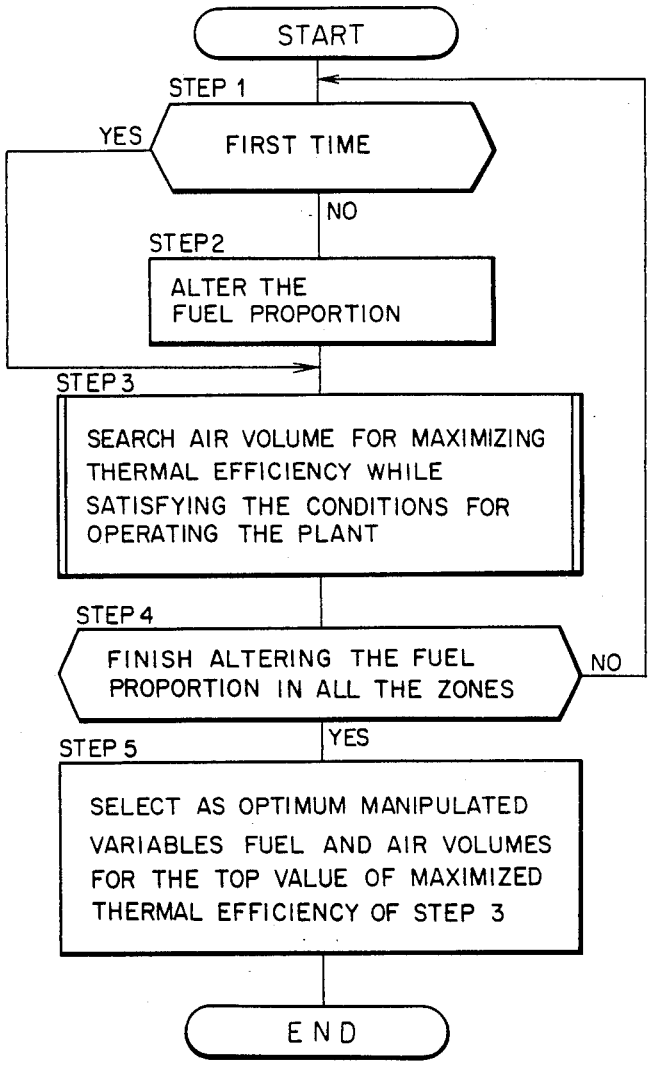

FIG. 12 shows another example of an algorithm for searching the optimum manipulated variables for obtaining the maximum thermal efficiency. The operations will be described by referring to FIG. 12.

(1) Step 1

It is judged whether the search is going to be conducted for the first time. If it is the first search, then the operation shifts to step 3 by maintaining at current levels the amounts of fuel for all the regions of all the manipulated variables. If it is not the first search, the operation shifts to step 2.

(2) Step 2

The proportion of the amounts of fuel for all the regions is varied while the conditions for operating the plant shown by the equation (6) are satisfied, provided that the total of the amounts of fuel for all the regions satisfies the fuel volume requirement.

(3) Step 3

The amounts of air for all the regions are varied in accordance with a predetermined step while satisfying the requirements for operating the plant expressed by the equations (71)–(75), and values which maximize thermal efficiency as expressed by the equation (76) while satisfying the conditions for operating the plant as expressed by the equations (66)–(70) are searched. The values of thermal efficiency and the amounts of fuel and air are stored in a memory.

(4) Step 4

When the operation of varying the proportion of the amounts of fuel has not been finished for all the conditions for operating the plant expressed by the equation (6), the operation returns to step 1. When the operation has been finished for all the conditions, the operation shifts to step 5.

(5) Step 5

Of all the sets of thermal efficiency and the amounts of fuel and air, the amounts of fuel and air of the set in which thermal efficiency is maximized are selected as the optimum manipulated variables.

FIG. 13 shows one example of an algorithm for step 3 shown in FIG. 12. It has been found that, when three combustion modes or a regular combustion mode, a two-stage combustion mode and a denitration combustion mode are studied by using the air ratios of burner stages and NO port as parameters, the regular combustion mode shows the highest thermal efficiency, followed by the two-stage combustion mode and denitration combustion mode in the indicated order and the denitration combustion mode shows the lowest nitrogen oxides concentration, followed by the two-stage combustion mode and regular combustion mode in the indicated order. The example shown in FIG. 13 proposes, based on the aforesaid findings, to manipulate by trial the air ratios by using a method best suiting a prevailing combustion mode, to thereby maximize thermal efficiency while satisfying the conditions for operating the plant including the furnace outlet nitrogen oxides concentration and other factors. The operations performed along this line will be described by referring to FIG. 13.

In step 1 shown in FIG. 13, it is determined whether or not the furnace outlet nitrogen oxides concentration NOx exceeds the upper limit value $NOx_U$. When the former is determined to exceed the latter, the procedure for reducing the nitrogen oxides concentration and thermal efficiency is followed by shifting the operation to step 2 and the following. When the former is determined not to exceed the latter, the current furnace outlet nitrogen oxides concentration NOx is compared with the lower limit value $NOx_L$ in step 22. When the former is determined to be smaller than the latter, the operation shifts to step 23 and the following in which the nitrogen oxides concentration NOx is increased and thermal efficiency is improved. When the nitrogen oxides concentration NOx is between the upper limit value and lower limit value $NOx_U$ and $NOx_L$, the manipulation is finished by keeping the manipulated variables at the current levels.

The case in which the current nitrogen oxides concentration NOx exceeds the upper limit value $NOx_U$ of nitrogen oxides concentration will first be described.

In step 2, the type of the current combustion mode is determined as being one of the regular combustion mode, two-stage combustion mode and denitration combustion mode. Based on the determination, the operation shifts to the corresponding channel. Let us assume that the current combustion mode is determined to be the regular combustion mode.

(1) Steps 3, 4 and 5

The amounts of reduced nitrogen oxides for separate burner stages are controlled by varying the ratio of tertiary air to the secondary air without varying the stage-by-stage burner air ratio. Then, it is checked whether or not the conditions for operating the plant including the furnace outlet nitrogen oxides concentration NOx are satisfied. When it is determined that the conditions are not satisfied, the steps 3–5 are performed repeatedly, until they are satisfied when the operation shifts to step 6.

(2) Steps 6, 7 and 8

Thermal efficiency $\eta$ is calculated and its values and the manipulated variables obtained during this period are stored in the memory. When trial operations for the ratio of the tertiary air to the secondary air for all the regions have not been finished, the operation returns to step 3 to repeatedly perform steps 3–7. When they have been finished, the operation shifts to step 8 in which the highest value $\eta_{max}^1$ of all the values of thermal efficiency calculated in the steps ending in step 7 and manipulated variables $u^1$ obtained when the highest value of thermal efficiency was determined are stored in the memory, before the operation shifts to step 9.

(3) Steps 9, 10 and 11

In these steps, it is checked whether or not the conditions for operating the plant are satisfied by reducing the stage-by-stage burner air ratio at the same rate and simultaneously increasing after-air while keeping the amount of air in the furnace constant. When these conditions are determined not to be satisfied, the steps 9–11 are repeatedly performed. When they are satisfied, the operation shifts to step 12.

(4) Steps 12, 13 and 14

In these steps, thermal efficiency $\eta$ is calculated and its values and the manipulated variables obtained at that time are stored in the memory. When trial operations for the burner air ratio for all the regions have not been finished, the operation shifts to step 9 to repeatedly perform steps 9–13. When they have been finished, the operation shifts to step 14 in which the highest value $\eta_{max}^2$ of all the values of thermal efficiency calculated in the steps ending in step 13 and manipulated variables $u^2$ obtained when the highest value of thermal efficiency was determined are stored in the memory, before the operation shifts to step 15.

(5) Steps 15, 16 and 17

It is checked whether the conditions for operating the plant are satisfied or not by increasing the air ratio of an M burner stage and reducing the air ratio of a P burner stage shown in FIG. 5. If the conditions are not satisfied, steps 15–17 are repeatedly performed. When they are satisfied, the operation shifts to step 18.

(6) Steps 18, 19 and 20

Thermal efficiency $\eta$ is calculated and its values and the manipulated variables obtained during this period are stored in the memory. When trial operations for the burner air ratio for all the regions have not been finished, the operation shifts to step 15 to repeatedly perform steps 15–19. When they have been finished, the operation shifts to step 20 in which the highest value $\eta_{max}^3$ of all the values of thermal efficiency calculated in the steps ending in step 19 and manipulated variables $u^3$ obtained when the highest value of thermal efficiency was determined are stored in the memory before the operation shifts to step 21.

(7) Step 21

The manipulated variables corresponding to the value of thermal efficiency $\eta$ at the top of the highest values $\eta_{max}^1$ to $\eta_{max}^3$ are used as optimum manipulated variables.

When the type of the current combustion mode is determined to be the two-stage combustion mode in step 2, the procedures including step 9 to step 21 are performed to search the optimum manipulated variables for the two-stage and denitration combustion modes. Meanwhile, when the current combustion mode is determined to be the denitration combustion mode, trial operations for the air ratios are performed in the denitration combustion mode, to determine the optimum manipulated variables in steps 15–21.

Operations to be performed when the current nitrogen oxides concentration exceeds the upper limit value and operations to be performed when the current nitrogen oxides concentration drops below the lower limit value will now be described.

In step 23, the type of the combustion mode is determined and suitable operations are performed by following the predetermined procedures based on the result of the determination. Operations to be performed when the current combustion mode is determined to be the denitration combustion mode will first be described.

(1) Steps 24, 25 and 26

Trial operations are performed by keeping constant the air ratios of the burner as a whole by increasing the air ratios of P burner and reducing the air ratios of M burner, so as to check whether or not the conditions for operating the plant are satisfied. When the conditions are found not to be satisfied, steps 24–26 are repeatedly performed. When they are found to be satisfied, the operation shifts to step 27.

(2) Steps 27, 28 and 29

Thermal efficiency $\eta$ is calculated and its values and the manipulated variables obtained at that time are stored in the memory. Then, steps 24–28 are repeatedly performed until the burner air ratios for the P stage become equal to those for the M stage (two-stage combustion mode), and the operation shifts to step 29 when they have become equal to each other. In step 29, the highest thermal efficiency value $\eta_{max}^{1'}$ of all the thermal efficiency values calculated in the steps ending in step 28 is determined and the manipulated variables $u^{1'}$ used when thermal efficiency achieved the highest value $\eta_{max}^{1'}$ are obtained, before the operation shifts to step 30.

(3) Steps 30, 31 and 32

The air ratios of the burner of all the stages are increased at the same rate, and the after-air is reduced. The operation shifts to step 33 when the conditions for operating the plant have been satisfied.

(4) Steps 33, 34 and 35

Thermal efficiency $\eta$ is calculated and its value and the values of manipulated variables obtained at that time are stored in the memory. Steps 30–34 are repeatedly performed until the after-air becomes zero (normal combustion mode). When the after-air has become zero, the highest thermal efficiency value $\eta_{max}^{2'}$ of all the thermal efficiency values calculated in the steps ending in step 34 is determined and the manipulated variables $u^{2'}$ used when thermal efficiency achieved the highest value $\eta_{max}^{2'}$ are determined. These values are stored in the memory before the operation shifts to step 36.

(5) Steps 36–41

The ratio of the tertiary air to the secondary air for each stage is varied, and the highest thermal efficiency value $\eta_{max}^{3'}$ and the manipulated variables $u^{3'}$ used when the thermal efficiency achieved the highest value are stored in the memory, before the operation shifts to step 42.

(6) Step 42

In this step, manipulated variables corresponding to the value of thermal efficiency at the top of the highest thermal efficiency values $\eta_{max}^{1'}$, $\eta_{max}^{2'}$ and $\eta_{max}^{3'}$ determined in steps 29, 35 and 41 respectively are obtained and used as optimum manipulated variables.

In the foregoing description made by referring to FIGS. 9–13, the results obtained by the trial operations have been described as being checked whether or not they satisfy the conditions for operating the plant. There are two methods available for checking the results of trial operations. One method consists in estimating responses to the trial operations by using, as shown in FIG. 7, the stage-by-stage nitrogen oxides estimation model, stage-by-stage unburned-coal-in-the-ash estimation model and furnace outlet exhaust gas concentration estimation model. The other method uses actual responses of the plant by directly applying manipulated variables by performing trial operations without using models, as shown in FIG. 8.

Figure 15:
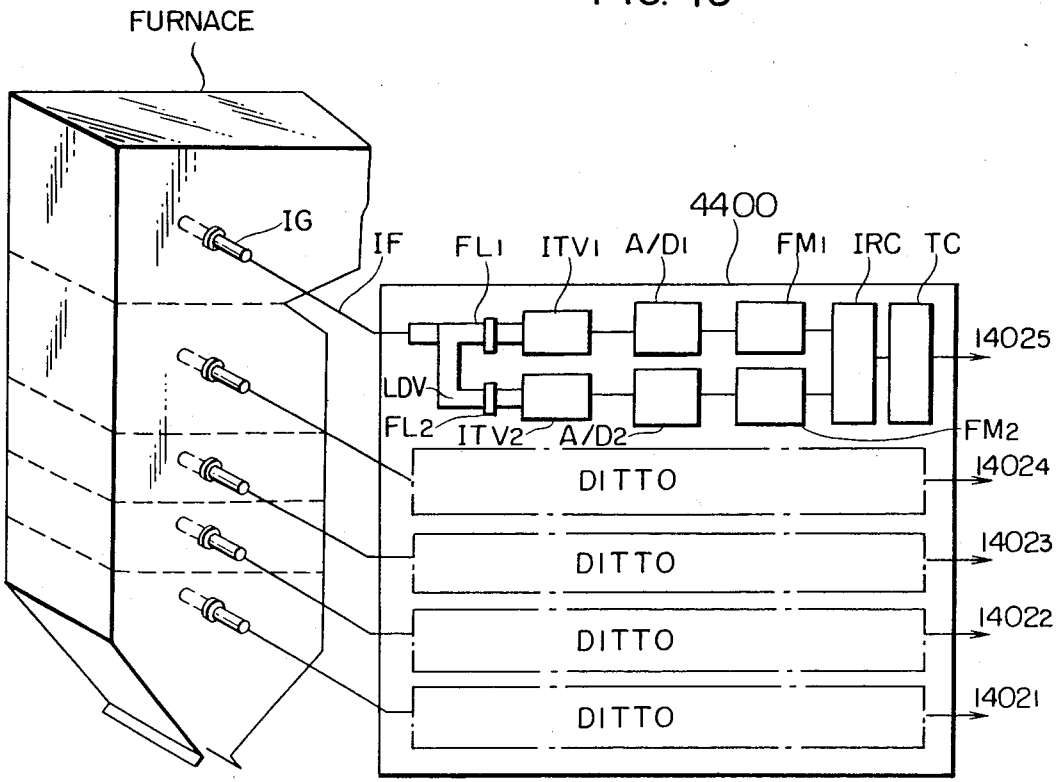
FIG. 15 is a view in explanation of the method of estimating the temperature of combustion gas.

The combustion gas temperature estimation function block 4400 will now be described. FIG. 15 shows one example of this block in which an image guide IG of the same construction as shown in FIG. 5 is located in the vicinity of the central portion of one side of each stage of the furnace to lead the brightness of combustion gas through image fibers IF to light division devices LDV where light is split into two portions which are introduced via single color filters $FT_1$ and $FL_2$ of different wavelengths to image-forming television systems $ITV_1$ and $ITV_2$, where brightness information transmitted through the filters is converted into video signals which are converted by analog-to-digital converters $A/D_1$ and $A/D_2$ into digital data. The digital data thus obtained is stored in flame memories $FM_1$ and $FM_2$ as two-dimensional brightness density image data. Then, the brightness ratio of corresponding picture elements of the two sets of image data is calculated by an image brightness ratio calculation section IRC. By using the brightness ratio, temperatures at points corresponding to the picture elements of the two-dimensional image and a mean value for the image as a whole are calculated by a two-color pyrometer method by a temperature calculation section TC. This calculation method will be described in detail.

The two-color pyrometer method will first be described. In FIG. 15, let the wavelengths of the single color filters $FL_1$ and $FL_2$ be denoted by $\lambda_1$(cm) and $\lambda_2$(cm), and the two-dimensional digital brightness density images obtained through the respective filters be denoted by $I_1(i, j)$ and $I_2(i, j)$ respectively. The brightness level may be 0~255, for example, and the (i, j) designate (x, y) coordinates of the picture elements constituting the images. If the numbers of the picture elements constituting each image vertically and transversely are represented by M and N respectively, then $i=0\sim(M-1)$ and $j=0\sim(N-1)$. Then, the relation between the temperatures T (i, j) at the coordinates (i, j) of the image and the brightness data can be expressed by the following equations in accordance with the Wien's formula:

$$I_1(i, j) = \epsilon \cdot \frac{C_1}{\lambda_1^5} \exp\left(-\frac{C_2}{\lambda_1 T(i, j)}\right) \tag{83}$$

$$I_2(i, j) = \epsilon \cdot \frac{C_1}{\lambda_2^5} \exp\left(-\frac{C_2}{\lambda_2 T(i, j)}\right) \tag{84}$$

where $\epsilon$: the radiation power.

T(i,j): the temperatures (K) at the coordinates (i, j).

$C_1$: $3.7403\times10^{-5}$ erg.cm$^2$/s.

$C_2$: 1.4387 cm.K $\lambda_1, \lambda_2$: wavelengths (cm).

By obtaining the ratio of equation 83 to equation 84 and doing some tidying-up, the following equation can be obtained:

$$\frac{1}{T(i, j)} = k_1\left(l_n \frac{I_1(i, j)}{I_2(i, j)} + k_2\right) \tag{85}$$

Therefore, $$k_1 = \frac{\lambda_1 \lambda_2}{C_2 (\lambda_1 - \lambda_2)} \quad (86)$$

$$k_2 = l_n \left( \frac{\lambda_1}{\lambda_2} \right)^5 \quad (87)$$

The brightness ratio $I_1(i, j)/I_2(i, j)$ of the equation (85) is calculated by a brightness ratio calculation section IRC shown in FIG. 15, and the result obtained is used to calculate the temperatures of the points of the coordinates (i, j) by the temperature calculation section TC based on the equations (85)-(87). A mean temperature $T_{av}$ is obtained by the following equation:

$$T_{av} = \frac{\sum_{i=0}^{M-1} \sum_{j=0}^{N-1} T(i, j)}{M \cdot N} \quad (88)$$

By using the equation (88), it is possible to estimate combustion gas temperatures in separate regions.

In the furnace heat transfer model 4506 shown in FIGS. 8 and 16 for the algorithm for determining the optimum manipulated variables, the combustion ratio $K_{ji}$ shown in equation (1) is strongly correlated to combustion temperatures in regions i and j, and this ratio can be expressed as a function f of the combustion temperatures, as follows:

$$K_{ji} = f(T_j, T_i) \quad (89)$$

where $T_j$ the mean combustion temperature in the region j.

$T_i$ the mean combustion temperature in the region i.

As a simple example of the equation (89), the following multiple regression equation is effective:

$$K_{ji} = b_o + b_i \cdot T_j + b_2 \cdot T_i + b_3 T_j \cdot T_i \quad (90)$$

where $b_o \sim b_3$ the partial regression coefficients.

If the combustion temperatures are regarded as being equivalent to burner flame temperatures with regard to burner stages and to combustion gas temperatures with regard to other regions than the burner stages, then the burner flame temperatures can be estimated by the two-color pyrometer method described in Japanese patent application No. 118298/84 which includes production of burner flame images and the combustion gas temperatures can be estimated by the two-color pyrometer method shown in FIG. 15 and equations (83)-(88). In summary, the combustion ratio can be estimated based on the burner flame information and combustion gas brightness information as the result of trial operations applied to the plant. However, in the case of the algorithm for determining the optimum manipulated variables shown in FIG. 7, responses provided by the plant to the trial operations are estimated by a model, so that the two-color pyrometric method referred to hereinabove should be replaced by a model for estimating the flame temperature and combustion gas temperature. The method of estimation that would be most practical would be to renew at all times the tables of flame and combustion gas temperatures corresponding to the amounts of fuel and air as a result of studies of operations of the plant, so that the tables can be used any time as desired.

Figure 16:
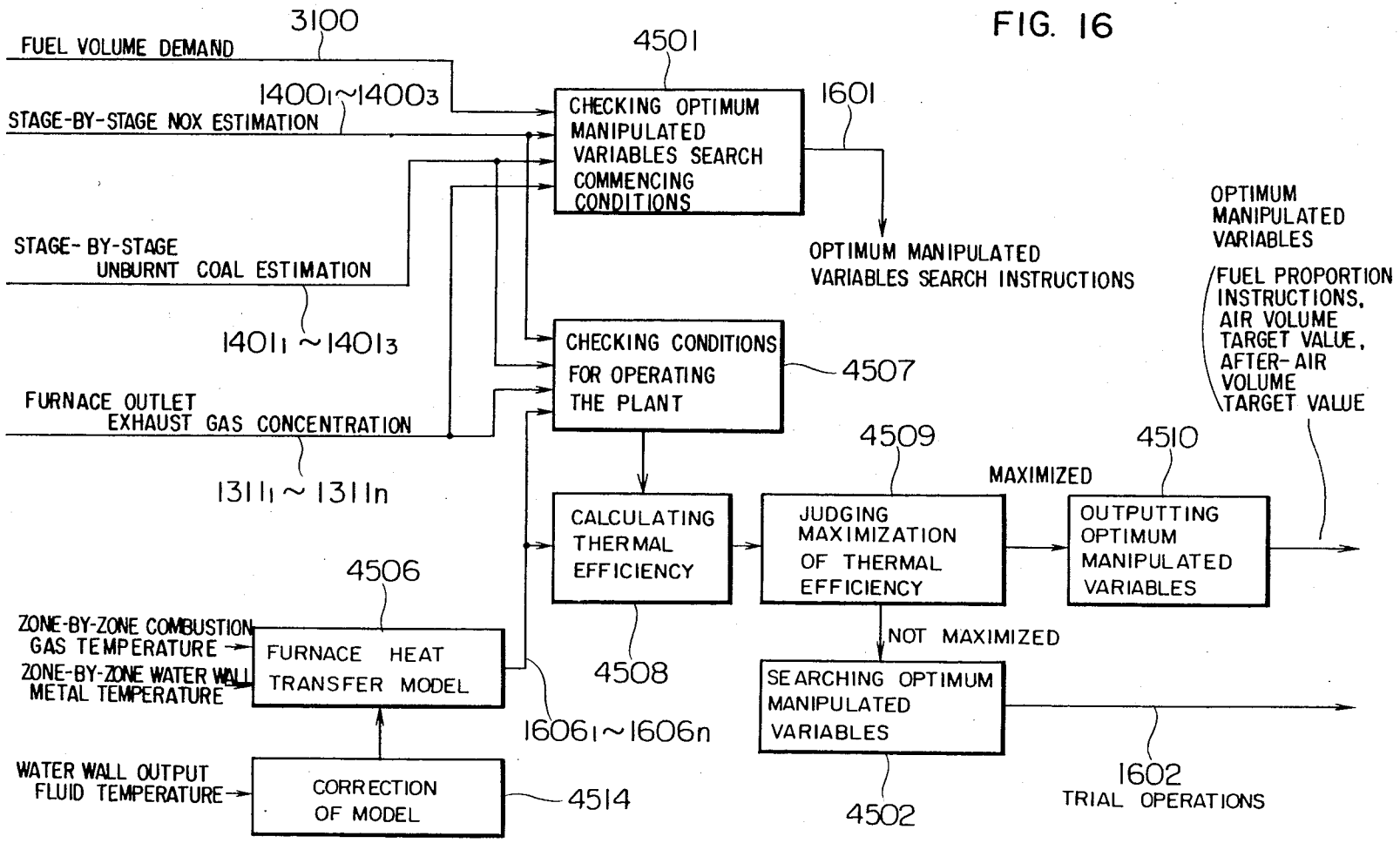
FIG. 16 shows a further constructional form of the stage-by-stage fuel/air proportion calculation function block.

FIG. 16 shows a modification of the example shown in FIG. 8, in which actual response results of the combustion gas temperature and furnace wall metal temperature with respect to a trial operation 1602 are calculated and the values obtained as the results of calculation are used to calculate thermal efficiency by the furnace heat transfer model 4506. This eliminates the need to use a model for calculating the combustion gas temperature and water wall metal temperature for the furnace heat transfer model 4506, thereby allowing the models to be simplified.

With regard to the stage-by-stage combustion safety evaluation function block 4300 shown in FIG. 3, different constructional forms may be adopted depending on the method used for evaluating the safety. When the safety evaluation method disclosed in Japanese patent application No. 184657/84 is employed, the function for estimating the area of the flame with respect to the trial operation 1602 as shown in FIG. 7 may be added to the block and the safety of combustion may be evaluated based on an estimate provided by this function. If the result obtained indicates abnormality, then the trial operation would be ruled unsuitable and nullified. When the method disclosed in Japanese patent application No. 174998/84 is used, the function for estimating the shape of the flame with respect to the trial operation 1602 as shown in FIG. 7 may be added to the block and the safety of combustion may be evaluated based on an estimate provided by this function. If the result obtained indicates abnormality, then the trial operation would be ruled unsuitable and nullified. Thus, it is possible to avoid any disturbances that might render combustion in the boiler unstable.

The method of checking whether or not the conditions for operating the plant are satisfied when after-air is increased or decreased in amount will be described by referring to FIG. 17-20.

Figure 17:
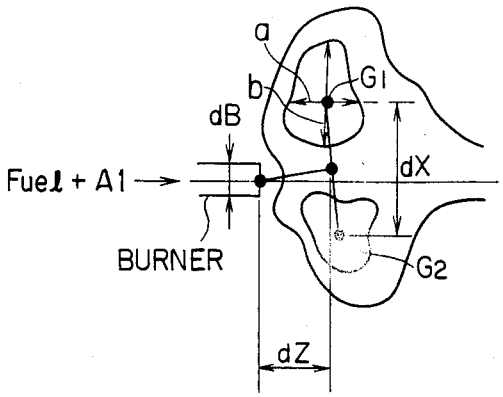
FIG. 17 shows an oxidizing flame distribution obtained by using a two-dimensional high and low density image signal.

FIG. 17 shows the distribution of the oxidization regions of a flame obtained by a two-dimensional high and low density image signal produced by the flame image measuring function block 4000.

The following values are obtained from FIG. 17 as characteristic parameters of the oxidization regions of the flame:

The distance from the forward end of the burner to the oxidization regions . . . $X = dZ/dB$ . . . (91)

The distance between the oxidization regions . . . $Y = dX/dB$ . . . (92)

The thickness coefficient of the oxidization regions . . . $Z = a/b$ . . . (93)

where a: the radial thickness of the oxidization regions of the flame.

b: the axial thickness of the oxidization regions of the flame.

$G_1, G_2$: the positions of the centers of gravity.

In the equations (91) and (92), the ratios of the distances dZ and dX to the diameter of the burner dB are used. However, this is not restrictive and the values of dZ and dX may be used as they are.

Thus, the estimate index $I_{UBC}$ of the unburned coal in the ash may be defined as follows, for example, by using the equations (91) and (92):

$$L_{UBC} = k \cdot X^{-1} \cdot Y^{-1} \cdot Z \quad (94)$$

where 1 is the primary aperture coefficient.

Meanwhile, the following may be used as the characteristic parameters of the oxidization regions of a flame in addition to those described hereinabove.

The $G_1$ and $G_2$ representing X and Y in FIG. 17 may be defined as follows:

(1) The $G_1$ and $G_2$ shown in FIG. 17 would constitute the centers of the oxidization regions of the flame.

(2) The $G_1$ and $G_2$ would be the positions which are nearest the oxidization regions of the flame as viewed from the forward end of the burner with respect to X.

(3) The $G_1$ and $G_2$ would be the positions in which the flame temperature is highest.

(4) The oxidization regions would be obtained by the temperature distribution and $G_1$ and $G_2$ would be their centers of gravity.

Z may be used to designate the thickness of a flame as viewed radially of the burner. However, these are all parameters designating the positions of the oxidization regions of a flame from the forward end of the burner or their size. In this connection, they need not necessarily designate the centers of gravity or thickness. However, the brightnesses (or temperatures) of the oxidization regions of a flame are distributed along a contour line and the area of the oxidization regions undergoes a change in accordance with the values restricting the separation of the high brightness zone. But the position of the center of gravity is not affected by these values. Thus, the use of the center of gravity as a characteristic parameter for the oxidization region would be considered appropriate.

One example of the method of estimating the unburned coal in the ash in the vicinity of the burner which uses the shape of a flame has been described hereinabove.

Figure 18:
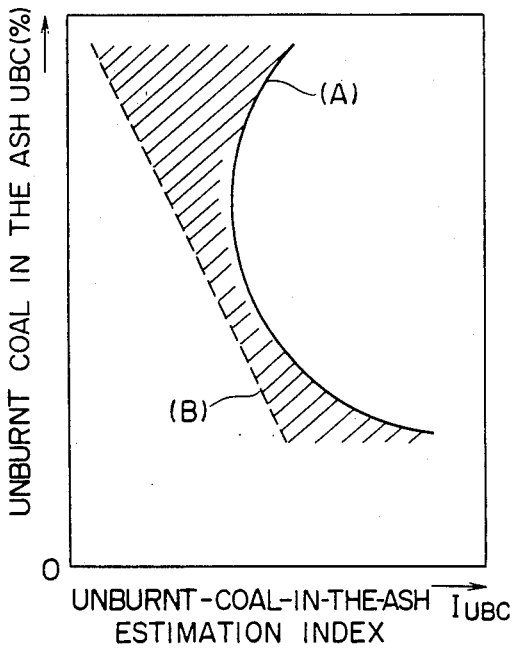
FIG. 18 is a diagram showing the unburned coal remaining in the ash and the indexes of estimation as effected by after-air.
Figure 19:
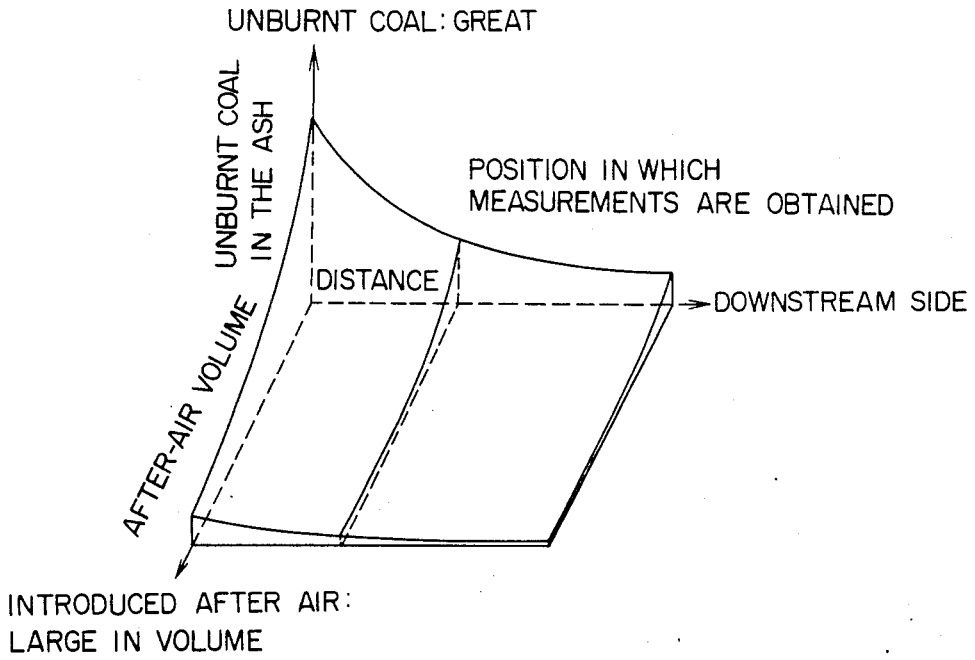
FIG. 19 shows the process in which the unburned fuel remaining in the ash is reduced in amount in relation to the amount of after-air introduced into the furnace and the distance.

After-air will be fed into the flame at its downstream side. When this is the case, the relation between the unburned coal in the ash UBC and its estimated index $I_{UBC}$ is as shown in FIG. 18. FIG. 18 shows that, owing to the influence of after-air, the unburned coal in the ash UBC has a region (indicated by a curve A) of two values with respect to the estimated index $I_{UBC}$.

FIG. 18 also shows that, when after-air is introduced in large amounts through an after-air port shown in FIG. 4A, the relation between the unburned coal in the ash UBC and its estimated index $I_{UBC}$ is linear as represented by a broken line B in FIG. 18.

This shows that the influences exerted by the introduction of after-air on the unburned coal in the ash UBC can be expressed as a function (particularly an exponential function) of the position in which measurements are made or the amount of the after-air, thereby making it possible to estimate the unburned coal in the ash with a high degree of accuracy with respect to the position in which the measurements are made.

The foregoing descriptions concern the unburned coal in the ash. However, other exhaust gas components, such as nitrogen oxides, sulfuer oxides, dust ash, etc., show the same tendency as the unburned coal in the ash UBC. One example of the operation of determining the influences exerted by the introduction of after-air on the unburned coal in the ash UBC will now be described.

An estimation term is added in the equation (94) to provide an equation (95) for estimating the unburned coal in the ash UBC as follows:

$$P(UBC)=K_1 \cdot I_{UBC}+K_2 \cdot \exp(\alpha)+C \tag{95}$$

where

P (UBC): the estimate of the unburned coal in the ash.

$I_{UBC}$: the estimation index of the unburned coal in the ash.

$\alpha$: the coefficient of the influences exerted by after-air.

$K_1$, $K_2$,C: the constants ($K_2$ is a constant which takes into consideration the time required for the after-air to cover the distance between the position in which it is introduced into the furnace and the position in which it is detected).

The $\alpha$ which designates the influences exerted by the after-air in the equation (95) is expressed as a function of the amount of after-air in the equation (96):

$$\alpha=g(G_{AA}, \ldots) \tag{96}$$

where $G_{AA}$ the amount of after-air.

The amount of after-air shown by the equation (96) can be expressed by using an air ratio as shown in the equation (97):

$$\alpha=g\{(\lambda-\lambda_{BNR}), \ldots\} \tag{97}$$

where $\lambda$: the total air ratio.

$\lambda_{BNR}$: the burner air ratio.

The $G_{AA}$ can be expressed by using the total amount of air and the amount of tertiary air.

The equation (95) has a term for estimating the influences exerted by the introduction of after-air on the unburned coal in the ash by using an exponent function. This is not restrictive and other functions may be used, as shown in the following equation:

$$P(UBC)=K_1 \cdot I_{UBC}+K_2 \cdot f\{g(G_{AA}), \ldots\}+C$$

$$P(UBC)=K_1 \cdot I_{UBC}+K_2 \cdot f\{g(\lambda-\lambda_{BNR}), \ldots\}+C \tag{98}$$

Processing operations performed based on the procedures described hereinabove will now be described by referring to the flow charts shown in FIGS. 20A and 20B.

Figure 20A:
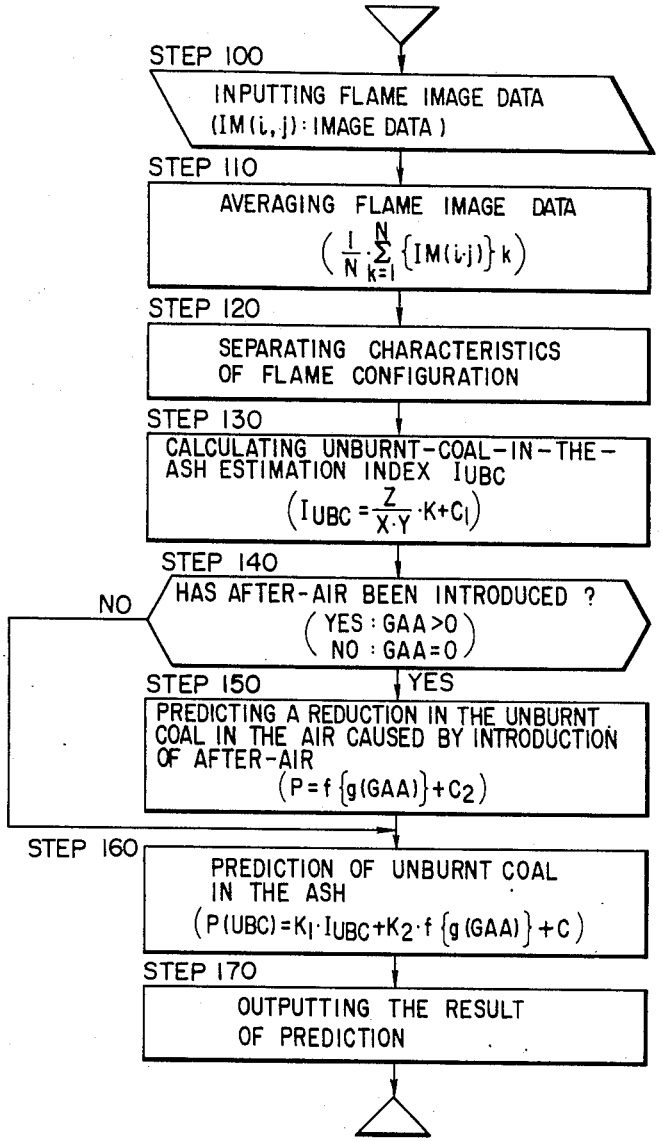
FIGS. 20A and 20B show flow charts for the process of estimating the influences exerted by afterair by estimating the amount of unburned fuel remaining in the ash which place limitations on the operation, based on the oxidizing flame distribution model shown in FIG. 17.

The processing operation performed as shown in FIG. 20A is as follows:

(1) Step (100: Inputting Flame Image Data

Flame image data IM (i, j) is inputted to a processor ($i=1\sim I$, $j=1\sim J$).

(2) Step 110: Averaging the Flame Image Data

A flame configuration having the highest probability of showing the condition of combustion is obtained. One example is shown as follows:

$$\hat{IM}(i,j)=\frac{1}{N}\sum_{k=1}^{N}\{IM(i,j)\}_k \tag{99}$$

where

IM (i, j): the averaged flame image.

K: the number of samples of averaging ($K=1\sim N$)

(3) Step 120: Separating the Characters of Flame Configuration

The high brightness and high temperature regions (oxidization regions of the flame) are separated by processing the image, and the relation between the burner and the separated regions (their centers of gravity) is calculated.

(4) Step 130: Calculating the Unburned-coal-In-the-Ash Estimation Index $I_{UBC}$ The unburned-coal-in-the-ash estimation index $I_{UBC}$ is obtained by using the equation (100):

$$I_{UBC} = \frac{Z}{X \cdot Y} \cdot K + C_1 \quad (100)$$

where K, $C_1$: the constants.

$$Z = a/b \quad (101)$$

where a: the thickness of the oxidization regions of the flame as viewed radially of the burner.

b: the thickness of the oxidization regions of the flame as viewed axially of the burner.

(5) Step 140: Is After-Air Introduced?

It is judged whether or not it is necessary to take the influences of after-air into consideration.

$$\text{Judgment} \left\{ \begin{array}{l} \text{Necessary (Yes): } G_{AA} > 0 \\ \text{Unnecessary (No): } G_{AA} = 0 \end{array} \right\}$$

$G_{AA}$: the amount of after-air.

(6) Step 150: Estimating a Reduction in the Amount of Unburned Coal in the Ash Caused by the Introduction of After-Air The amount of unburned coal in the ash showing a reduction while combustion takes place after the introduction of after-air is estimated.

$$P = f\{g(G_{AA}, \ldots)\} + C_2 \quad (102)$$

where $G_2$: the constant.

P: the estimated reduction.

$G_{AA}$: the amount of after-air.

In the equation (102), the function $g(G_{AA}, \ldots)$ is shown as including at least $G_{AA}$.

(7) Step 160: Estimating Unburned Coal in the Ash

Unburned coal in the ash is estimated by the equation (103) by using $I_{UBC}$ and P obtained previously.

$$P(UBC) = K_1 \cdot I_{UBC} + K_2 \cdot P + C \quad (103)$$

where

P(UBC): the estimated unburned coal in the ash.

P: the estimated reduction in amount.

$I_{UBC}$: the unburned-coal-in-the-ash estimation index.

$K_1, K_2, C$: the constants.

(8) Step 170: Outputting the Estimate

An estimate P(UBC) of unburned coal in the ash is outputted to an output device.

Figure 20B:
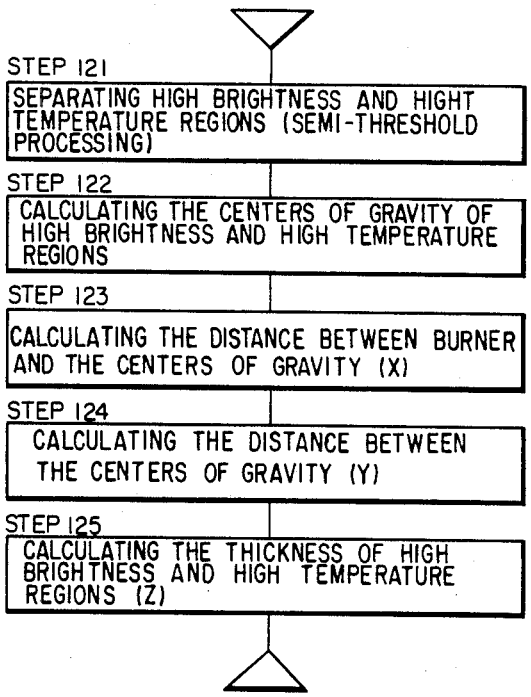

The processing operation performed as shown in FIG. 20B is as follows:

(1) Step 121: Separating the High Brightness and High Temperature Regions (Semi-Threshold Processing)

High brightness and high temperature regions (oxidization regions of a flame) are used as characteristics of the flame. Thus, these regions are separated by a semi-threshold processing. The semi-threshold processing refers to the processing of a high and low density image equation (104):

$$\text{When } \hat{IM}(i, j) \geqq TH, \ \hat{IM}(i, j) = \hat{IM}(i, j) \quad (104)$$
$$\text{When } \hat{IM}(i, j) < TH, \ \hat{IM}(i, j) = 0$$

where

IM (i, j): the averaged flame image (high and low density image)

TH: the semi-threshold value level.

(2) Step 122: Calculating the Centers of Gravity of the High Brightness and High Temperature Resin The centers of gravity of the high brightness and high temperature regions (oxidization regions of the flame) separated by the semi-threshold treatment are obtained. In this example, the centers of gravity of the regions are used as the typical points. However, similar results can be achieved by using the points of highest brightness and highest temperature as the typical points of the regions.

(3) Step 123: Calculating the Positions of the Centers of Gravity with respect to the burner (X)

X (the distance between the burner and the centers of gravity of the oxidization regions of the flame) is obtained as one of the characteristic parameters for determining the unburned-coal-in-the-ash estimation index $I_{UBC}$. The high brightness and high temperature regions will be hereinafter referred to as oxidization regions of a flame.

(4) Step 124: Calculating the Distance between the Centers of Gravity (Y)

Y (the distance between the centers of gravities of the oxidization regions of the flame) is obtained as one of the characteristic parameters for determining the unburned-coal-in-the-ash estimation index $I_{UBC}$.

(5) Step 125: Calculating the Thickness of the High Brightness and High Temperature Regions (Z)

The thicknesses of the oxidization regions of the flame as viewed radially and axially of the burner are obtained, and the coefficient of the thickness of the oxidization regions in the axial direction of the burner is calculated by using the equation (101).

From the foregoing description, it will be appreciated that it is possible according to the invention to provide estimates of unburned coal in the ash and a reduction in the amount of unburned coal in the ash based on an image of a flame, so as to thereby estimate or predict the unburned coal in the ash in a position in which measurements are made with a high degree of accuracy.

What is claimed is:

1. A combustion control method for a furnace, in a boiler, having one or more combustion zones in each of which a burner can be controlled by adjusting the amounts of fuel and air, comprising the steps of:

(a) obtaining a two-dimensional high and low density image having a high and low density regions from a combustion flame and combustion gas in each combustion zone by means of image fiber means and image forming camera means;

(b) estimating for each combustion zone the concentration of $NO_x$ in accordance with the two-dimensional high and low density image obtained from the combustion flame in each combustion zone, and estimating the concentration of NOx at the outlet of the furnace with the use of the estimated concentration for each combustion zone;

(c) estimating for each combustion zone the amount of unburnt coal in ash in accordance with the two-dimensional high and low density image obtained from the combustion flame in each combustion zone, and estimating the amount of unburnt coal in ash at the outlet of the furnace with the use of the thus estimated amount of unburnt coal in ash;

(d) evaluating the stability of combustion with the use of the two-dimensional high and low density image for each combustion zone;

(e) estimating the thermal efficiency of the boiler upon controlling of the amounts of fuel and air for each combustion zone with the use of a furnace heat transfer model; and (f) changing the amounts of fuel and air for each combustion zone when the stability of combustion is satisfactory while either one of the estimated concentration of $NO_x$ at the outlet of the furnace and the estimated amount of unburnt coal in ash thereat exceeds the associated limited value, to allow either one of the estimated concentration of $NO_x$ at the outlet of the furnace and the amount of unburnt coal in ash thereat to satisfy the associated limiting condition while to maximize the boiler efficiency.

2. A combustion control method as set forth in claim 1, wherein said high density areas of said two-dimensional high and low density image are defined as oxidization flame regions each having a gravity center and are formed at two different regions divided by the center axial line of said burner for each combustion zone, and said concentration of $NO_x$ at the outlets of said furnace upon steady state combustion is estimated by use of a model using, as variables, an $NO_x$ reduction value for each burner which is estimated from at least one of three kinds of values consisting of the positions of the gravity centers of said oxidization flame regions, the distance between said gravity centers of said oxidization flame regions and the degree of shape of said oxidization flame regions, an air ratio for each burner an averaged burner air ratio for each combustion zone and an amount of fuel for each combustion zone.

3. A combustion control method as set forth in claim 1, wherein said high density areas of said two-dimensional high and low density image are defined as oxidization flame regions each having gravity center and are formed at two differenct regions divided by the center axial line of said burner for each combustion zone, and the amount of unburnt coal in ash at the outlet of the furnace upon steady state combustion is estimated by use of a model using, as variables, the index of unburnt coal in ash estimated from at least one of four kinds of values consisting of the positions of the gravity centers of said oxidization flame regions, the distance between the gravity centers of said oxidization flame regions and burner primary air amount for each combustion zone, an after-air amount, a furnace air ratio and an averaged burner air ratio.

4. A combustion control method as set forth in claim 1, wherein said two-dimensional high and low density image provides the area of combustion flame region and the area of a high brightness region, and said stability of combustion is evaluated by use of a model using, as a variable, the ratio of the area of the combustion flame and the area of the high brightness region.

5. A combustion control method as set forth in claim: 1, wherein said high density regions of said two-dimensional high and low density image are defined as oxidization flame regions each having a gravity center and are formed at two different regions divided by the center axial line of said burner for each combustion zone, and said safety of combustion is evaluated by use of a model using, as a variable, at least one of the following kinds of values, the positions of the gravity centers of said oxidization flame regions, the distance between the gravity centers of the oxidization flame regions, the thickness of the oxidization flame regions, an averaged brightness of the oxidization flame region and timed fluctuations in said values of said kinds.

6. A combustion control method as set forth in claim 1, wherein the total value of an input heat and a combustion generated heat and the total value of amounts of heat absorbed by fluid in heat transfer pipes in the furnace are obtained by use of furnace heat transfer physical models for estimating the temperature of combustion gas, the temperature of heat transfer pipe metal and the temperature of fluid in the heat transfer pipes, for each combustion zone, with the use of the amount of supplied fuel and air as input values for each combustion zone, to thereby obtain the thermal efficiency in the form of a ratio of the latter to the former.

7. A combustion control method as set forth in claim 1, wherein the total value of an input heat and a combustion generated heat and the total value of amounts of heat absorbed by the furnace heat transfer pipe metals are obtained by use of furnace heat transfer models for estimating the temperature of combustion gas, the temperature of the heat transfer pipe metal and the temperature of fluid in the heat transfer pipes for each combustion zone, with the use of the amount of supplied fuel and air as input values for each combustion zone, to thereby estimate the thermal efficiency in the form of a ratio of the latter to the former.

8. A combustion control method as set forth in claim 1, wherein there are provided a model for predicting the concentration of $NO_x$ at the outlet of the furnace and a model for predicting the amount of unburnt coal in ash thereat to carry out the trial and error operation for the amounts of fuel and air for each combustion zone in order to determine optimum amounts of fuel and air for each combustion zone, and the control amounts of trial and error operation for fuel and air are internally changed to repeat the trial and error operation until prediction values obtained by these models satisfy the restrictions imposed on the concentration of $NO_x$ and the amount of unburnt coal in ash at the outlet of the furnace, thereby to actually control the amounts of fuel and air for each combustion zone with the use of the control amounts of trial and error operation, as optimum values, which satisfy either of said restrictions and which allow the thermal efficiency to be maximum.

9. A combustion control method as set forth in claim 8, wherein the concentration of $NO_x$ for each combustion zone is at first predicted from the control amounts of trial and error operation for fuel and air for each combustion zone by use of a multiple regression model, and the prediction value of concentration of $NO_x$ at the outlet of the furnace is obtained with the use of the thus obtained prediction value of concentration of $NO_x$ for each combustion zone.

10. A combustion control method as set forth in claim 8, wherein at first the amount of unburnt coal in ash is predicted from the control amounts of fuel and air by use of a multiple regression model to determine the prediction value of amount of unburnt coal in ash at the outlet of the furnace.

11. A combustion control method as set forth in claim 1, wherein detection is made such that the difference between the measured value of concentration of $NO_x$ at the outlet of the furnance and the predicted value thereof exceeds an allowable value, and the multiple regression model for predicting the concentration of $NO_x$ for each combustion zone is reconstituted by a multiple regression analysis method with the use of the estimated value of concentration of $NO_x$ which is estimated from the two-dimensional high and low density image for each combustion zone, in accordance with the actual control amounts of fuel and air for each combustion zone.

12. A combustion control method as set forth in claim 9, wherein detection is made such that the difference between the measured amount of unburnt coal in ash at the outlet of the furnace and the prediction value of the amount of unburnt coal in ash at the outlet of the furnace exceeds an allowable value, and the multiple regression model for predicting the amount of unburnt coal in ash for each combustion zone is reconstituted by a multiple regression analysis method with the use of the estimated value of amount of unburnt coal in ash which is estimated from the two-dimensional high and low density image for each combustion zone, in accordance with the actual control amounts of fuel and air for each combustion zone.

13. A combustion control method as set forth in claim 1, wherein optimum control amounts of fuel and air for each combustion zone are searched and determined by the simplex method for obtaining the maximum point of the thermal efficiency of a boiler.

14. A combustion control method as set forth in claim 13, wherein when the search for optimum control amounts of fuel and air to determine the maximum point of the boiler efficiency is carried out at first time, fuel distribution to all combustion zones is maintained constant to search and determine the amount of air which maximized the boiler efficiency, and by holding the above-mentioned condition the fuel distribution which maximized the boiler efficiency is then searched and determined, thereby the distributions of air and fuel which maximize the boiler efficiency are determined as optimum control amounts.

15. A combustion control method as set forth in claim 6, wherein coefficients used for the furnace heat tranfer models are compensated for such that the respective difference values, for each combustion zone, between the estimated value of temperature of combustion gas estimated from the two-dimensional high and low density image of combustion gas and the estimated value of the temperature-of combustion gas obtained by use of the associated model, between the measured value of the temperature of the heat transfer pipe metal and the estimated value of the temperature of heat transfer pipe metal obtained by use of the associated model, and between the measured value of the temperature of fluid in an outlet of the heat transfer pipes outlet and the estimated value of the temperature of fluid in the outlet of the heat transfer pipes obtained by use of the associated model are decreased.

16. A combustion control method as set forth in claim 7, wherein coefficients used for the furnace heat transfer models are compensated for such that the respective difference values, for each combustion zone, between the estimated value of the temperature of combustion gas estimated from the two-dimensional high and low density image of combustion gas and the estimated value of the temperature of combustion gas obtained by use of the associated model, between the measure value of the temperature of the heat transfer pipe metal and the estimated value of the temperature of heat transfer pipe metal obtained by use of the associated model, and between the measured value of the temperature of fluid in an outlet of the heat transfer pipes outlet and the estimated value of the temperature of fluid in the outlet of the heat transfer pipes obtained by use of the associated model are decreased.

17. A combustion control method as set forth in claim 6, wherein in the furnace heat transfer model, the rate of combustion of fuel fed to each combustion zone is calculated as a function of the temperature of the combustion flame for each combustion zone which is estimated with the use of a high temperature bicolor thermometer in accordance with the two-dimensional high and low density image of combustion flame.

18. A combustion control method as set forth in claim 7, wherein in the furnace heat transfer model, the rate of combustion of fuel fed to each combustion zone is calculated as a function of the temperature of the combustion flame for each combustion zone which is estimated with the use of a high temperature bicolor thermometer in accordance with the two-dimensional high and low density image of combustion flame.

19. A control combustion method as set forth in claim 1, wherein the boiler heat transfer efficiency is calculated by use of the furnace heat transfer model for estimating the temperature of fluid in heat transfer tubes of the boiler for each combustion zone with the use of, as input values, the estimated value of the temperature of combustion gas estimated from the two-dimensional high and low density image of combustion gas for each combustion zone and the measured value of the temperature of the heat transfer tube metal, in addition to the feed amount of fuel and air for each combustion zone.

* * * * *